US011047573B2

(12) United States Patent
Fisher et al.

(10) Patent No.: US 11,047,573 B2
(45) Date of Patent: Jun. 29, 2021

(54) FLARE MONITORING AND CONTROL METHOD AND APPARATUS

(71) Applicant: Chevron Phillips Chemical Company LP, The Woodlands, TX (US)

(72) Inventors: Charles F. Fisher, Conroe, TX (US); Lee N. Green, Houston, TX (US); Gregory G. Hendrickson, Kingwood, TX (US); Thomas A. Lessard, Orange, TX (US); Kenneth B. Moore, Katy, TX (US); Daniel W. Peneguy, League City, TX (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 193 days.

(21) Appl. No.: 16/262,445

(22) Filed: Jan. 30, 2019

(65) Prior Publication Data

US 2019/0242575 A1 Aug. 8, 2019

Related U.S. Application Data

(60) Provisional application No. 62/781,401, filed on Dec. 18, 2018, provisional application No. 62/626,248, filed on Feb. 5, 2018.

(51) Int. Cl.

| | |
|---|---|
| ***F23G 7/00*** | (2006.01) |
| ***F23G 7/08*** | (2006.01) |
| ***F23L 7/00*** | (2006.01) |

(52) U.S. Cl.

CPC ..... *F23G 7/085* (2013.01); *F23L 7/005* (2013.01); *F23G 2207/10* (2013.01); (Continued)

(58) Field of Classification Search

CPC ..... F23G 7/085; F23G 2207/10; F23G 2207/102; F23G 2207/103; F23G 2207/108; F23G 2207/112; F23G 2207/20; F23G 2209/14; F23G 2900/55011; F23L 7/005; F23K 2900/05001; F23K 2900/05004

See application file for complete search history.

(56) References Cited

U.S. PATENT DOCUMENTS 2,779,399 A * 1/1957 Zink ..... F23G 7/08 431/90
3,463,613 A * 8/1969 Fenske ..... G01N 21/72 436/55

(Continued)

FOREIGN PATENT DOCUMENTS

WO 2017009158 1/2017

OTHER PUBLICATIONS

Marc McDaniel, Flare Efficiency Study, prepared for the U.S. Environmental Protection Agency EPA-600/2-83/052 (Jul. 1983).

(Continued)

*Primary Examiner* — Alfred Basichas
(74) *Attorney, Agent, or Firm* — Conley Rose. P.C,

(57) ABSTRACT

Disclosed herein are embodiments of a flare control method and a flare apparatus for automatically controlling, in real-time, the flow of one or more of fuel, steam, and air to a flare. The disclosed embodiments advantageously allow for automated control over a wide spectrum of operating conditions, including emergency operations, and planned operations such as startup and shutdown.

13 Claims, 6 Drawing Sheets

(52) U.S. Cl.
CPC .. *F23G 2207/102* (2013.01); *F23G 2207/103* (2013.01); *F23G 2207/108* (2013.01); *F23G 2207/112* (2013.01); *F23G 2207/20* (2013.01); *F23G 2209/14* (2013.01); *F23G 2900/55011* (2013.01); *F23K 2900/05001* (2013.01); *F23K 2900/05004* (2013.01)

(56) References Cited

U.S. PATENT DOCUMENTS

| | | | | |
|---|---|---|---|---|
| 4,854,855 | A * | 8/1989 | Rajewski | F23G 7/085 431/202 |
| 6,960,075 | B2 * | 11/2005 | Rajewski | F23L 17/16 239/DIG. 7 |
| 7,014,824 | B2 | 3/2006 | Krodel et al. | |
| 7,051,765 | B1 | 3/2006 | Kelley et al. | |
| 8,096,803 | B2 | 1/2012 | Mashhour et al. | |
| 9,267,686 | B1 | 2/2016 | Little et al. | |
| 9,677,762 | B2 | 6/2017 | Tullos | |
| 2011/0008503 | A1 | 1/2011 | Groves et al. | |
| 2017/0191350 | A1 * | 7/2017 | Johns | E21B 43/26 |
| 2018/0003381 | A1 * | 1/2018 | Pizarro | F23D 14/48 |

OTHER PUBLICATIONS

Parameters for Properly Designed and Operated Flares, U.S. Environmental Protection Agency Office of Air Quality Planning and Standards (Apr. 2012).

Adam Bader et al., Selecting the Proper Flare Systems, CEP, Jul. 2011 at 45.

Kolmetz Handbook of Process Equipment Design, Flare Systems Safety, Selection and Sizing, Rev:01 pp. 1-19 (2007).

Petroleum Refinery Sector Risk and Technology Review and New Source Performance Standards, 79 Fed. Reg. 36,880 (Jun. 30, 2014).

* cited by examiner

FLARE MONITORING AND CONTROL METHOD AND APPARATUS

CROSS-REFERENCE TO RELATED APPLICATIONS

The present application is a non-provisional of and claims priority to U.S. Provisional Patent Application Nos. 62/626,248 filed Feb. 5, 2018 and 62/781,401 filed Dec. 18, 2018, both entitled "Flare Monitoring and Control Method and Apparatus," each of which application is incorporated by reference herein in its entirety.

STATEMENT REGARDING FEDERALLY SPONSORED RESEARCH OR DEVELOPMENT

Not applicable.

BACKGROUND

This disclosure generally relates to the control of flow of one or more of air, steam, and supplemental fuel gas to a flare for efficient combustion of vent gases.

Chemical and petroleum production, refining, and processing plants and facilities use flares for burning and disposing of combustible gases. The sources of these plant gases include both continuous streams of combustible gases, and occasional streams of combustible gases. The system is also designed to burn and dispose of combustible gases from some or even all of the safety systems (e.g. relief valves, rupture disks, etc.) in the plant during an emergency shutdown. The flame of the flare is commonly elevated high above the ground on a flare stack, and a vent gas having flammable gaseous components can be directed to the flare. It is generally desirable that the vent gas is economically and completely consumed. Efficient combustion of the vent gas can be accomplished by supplying air or steam to the combustion zone of the flare along with a supplemental fuel gas as necessary. The amounts of air or steam along with the supplemental fuel gas are controlled to achieve a combustion efficiency of at least 96.5% (or a destruction efficiency of at least 98%). If not enough air or steam is present in the combustion zone of the flare, incomplete combustion can occur due to both the fuel rich combustion zone and incomplete mixing of the oxygen and fuel. The result is particulates seen as smoke. If too much air or steam is present, the combustion zone temperature drops, and incomplete combustion can occur which is environmentally undesirable and wastes valuable steam. This situation is not typically noticeable because particulates are not produced, and the incomplete combustion products are dispersed and diluted in the steam or air. If the combustible material present in the vent gas is not the correct amount (e.g. high enough flow) or the correct type (e.g. high enough heating value) to produce a combustion zone of the flare hot enough to achieve efficient combustion, then the supplemental fuel gas is added to the vent gas to raise the net heating value of the vent gas and increase the combustion zone temperature. If not enough supplemental fuel gas is added, then incomplete combustion can occur due to the lower combustion zone temperature or due to the flow rates through the combustion zone being below the design threshold of the flare. If too much of the supplemental fuel gas is added, then it is needlessly burned. Since the composition and/or flow of the vent gas can change greatly within seconds, for example, due to an emergency shutdown, balancing the amount of steam or air and supplemental fuel gas is difficult over the full range of vent gas flow rates.

Efficient combustion of vent gases can be automated, for example, by control systems coupled with the flare that control the flow of steam or air to the flare based on compositional measurements of the vent gas, or a gas stream containing the vent gas, that is analyzed by gas chromatography. The amount of time it can take to determine the composition of the vent gas is limited by the gas chromatography technique, usually no faster than every 7-10 minutes. Thus, such systems are unable to operate over the full range of operating conditions and will inefficiently combust the vent gas after a change in the vent gas composition and/or flow rate.

Control systems which depend on gas chromatography to measure the vent gas composition thus adapt (e.g., change the flow of steam or air) to new composition measurements no faster than every 7-10 minutes. Since the composition and/or flow of the vent gas can change greatly within seconds, for example, due to an emergency shutdown (e.g., loss of electricity, failure of key plant component, natural disaster), and planned operations (e.g., startup, normal shutdown, or normal transitions between sets of operating conditions), automatic control of steam or air flow based on gas chromatography measurements can lead to inefficient combustion for a window of time between the times when the GC measurements are taken due to more frequent (relative to GC measurement intervals) changes in the vent gas composition. Inefficient combustion during this window of time can lead to emissions which are not in compliance with environmental regulations even though a control system is in place to meet regulatory compliance.

To avoid inefficient combustion which can result from automatic control of steam or air based on GC measurements, the flow of air or steam to the flare is typically manually controlled. Manual control involves a plant operator visually monitoring the flare and adjusting the flow of steam or air to the flare based on visual input. As can be appreciated, manual control can be imprecise, risks inefficient combustion, carries its own safety concerns, is subjective, and must be transitioned back to automatic control once conditions are again suitable.

There is a need for a flare control method and apparatus that can maintain efficient combustion of vent gases by rapidly determining the concentration and species of vent gas components and then automatically controlling the flow of steam or air and supplemental fuel gas to a flare over a broader range of operating conditions which include emergency operations and/or sudden changes in the vent gas composition.

SUMMARY

A method as disclosed herein can include measuring a concentration of at least one hydrocarbon of a vent gas in a vent gas stream upstream of a combustion zone of a flare; feeding the vent gas in the vent gas stream to the flare; and controlling, in real-time based at least in part on the concentration of the at least one hydrocarbon, a flow of steam or air to the flare, optionally in addition to a flow of a supplemental fuel gas to the flare.

A flare apparatus as disclosed herein can include a flare having a combustion zone; a vent gas stream connected to the flare and configured to feed a vent gas to the flare upstream of the combustion zone; an air stream or a steam stream configured to feed air or steam to the flare; an online tunable infrared absorption based gas analyzer configured to analyze the vent gas in the vent gas stream or configured to analyze the vent gas in a flow path of the vent gas in the vent gas stream upstream of the combustion zone, wherein the gas analyzer is configured to measure a concentration of at least one hydrocarbon of the vent gas in the vent gas stream; and a control system coupled with the gas analyzer and configured to control, in real-time based at least in part on the concentration of the at least one hydrocarbon, a flow of steam or air to the flare, optionally in addition to a flow of a supplemental fuel gas to the flare.

The foregoing has outlined rather broadly the features and technical advantages of the disclosed inventive subject matter in order that the following detailed description may be better understood. The various characteristics described above, as well as other features, will be readily apparent to those skilled in the art upon reading the following detailed description of the preferred aspects and embodiments, and by referring to the accompanying drawings.

DESCRIPTION OF THE DRAWINGS

For a detailed description of the preferred aspects and embodiments of the disclosed methods and apparatuses, reference will now be made to the accompanying drawings in which.

DETAILED DESCRIPTION

Figure 1:
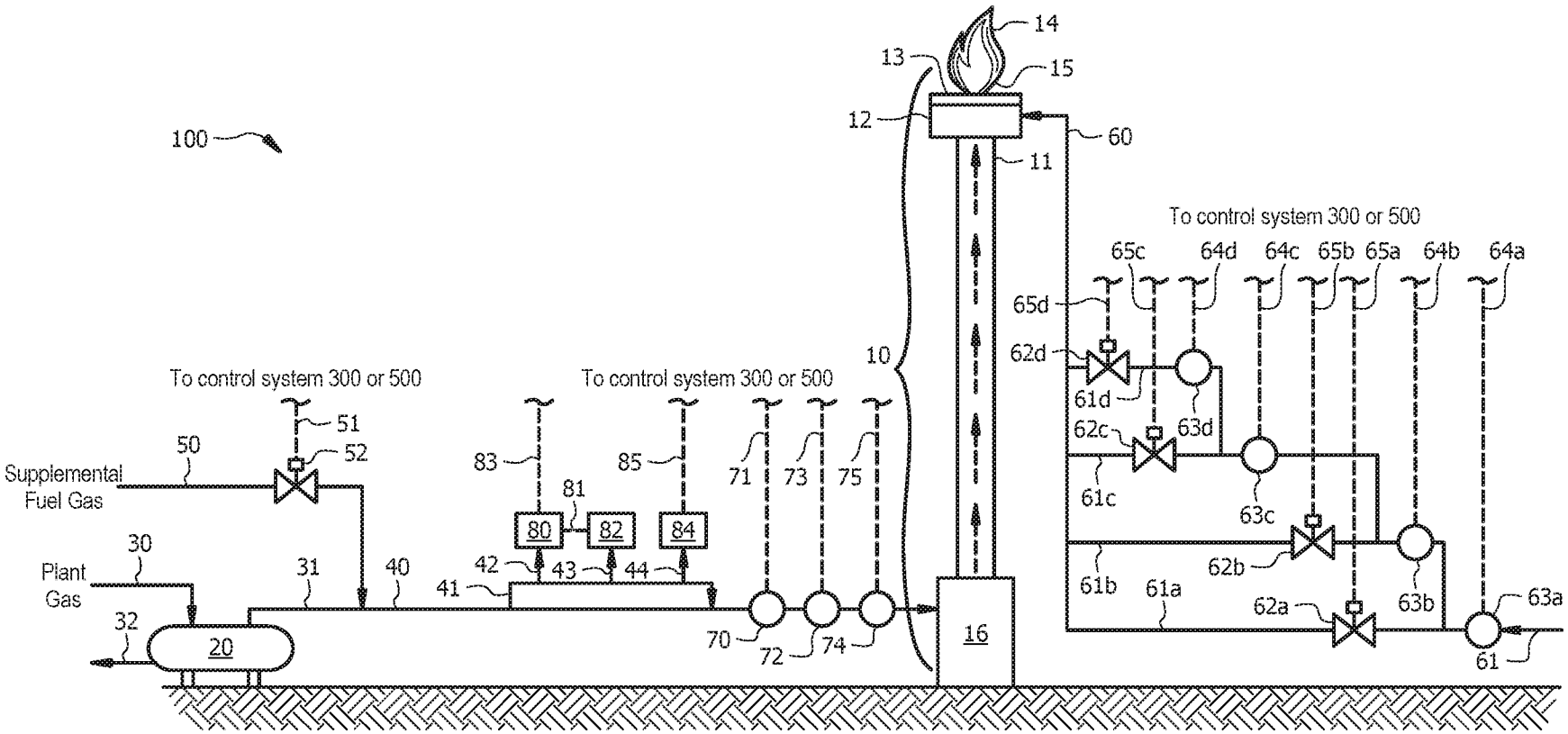
FIG. 1 illustrates a flare apparatus for steam-assisted flaring.

Disclosed herein are aspects and embodiments of a flare control method and flare control apparatus for automatically controlling, in real-time, the flow of one or more of steam, air, and supplemental fuel gas to a flare that is configured to combust a vent gas. The description may be in context of the apparatus or in context of method steps; however, it is contemplated that aspects and embodiments of the disclosed method can include features discussed in apparatus context and that aspects and embodiments of the disclosed apparatus can include features discussed in the method context.

The disclosed flare control method and apparatus improve the field of flaring because the flare control apparatus and flare control method disclosed herein advantageously allow for automated control over a wide spectrum of flare operating conditions, including emergency operations and planned operations, due to the real-time control. Moreover, the act of efficient combustion during a wide range of flaring conditions, i.e., the combustion of flammable components, results in more complete destruction of the vent gas components and better environmental performance of the plant.

As used herein, the term "vent gas" refers to the combination of organic and inorganic gases that can feed to a flare for combustion, including any supplemental fuel gas added as described herein.

As used herein, the term "supplemental fuel gas" refers to a fuel gas, a natural gas, one or more of a similar flammable gas, or a combination thereof.

As used herein, the term "real-time" means that controlling either the concentration of at least one hydrocarbon, the flow of steam, the flow of air, the flow of a supplemental fuel gas, or a combination thereof occurs less than one minute, preferably less than 20 seconds, after the measurement of the concentration of at least one hydrocarbon in a vent gas stream, the measurement of the velocity of the vent gas in the vent gas stream, or a combination thereof.

As used herein, the term "net heating value" is the lower heating value of a chemical component, in units of BTU/SCF, except where specifically noted otherwise.

As used herein, the term "combustion zone" of a flare is defined as the portion of the flame at the flare tip where the gas received from a vent gas stream is combined with steam and/or air and combusted.

As used herein, the term "efficient combustion" is defined as having a combustion efficiency or a destruction efficiency of at least the threshold set by local regulatory agencies.

$$\text{combustion efficiency \%} = \frac{CO_2}{CO_2 + CO + THC + Cp}$$

$$\text{destruction efficiency \%} = \frac{CO_2 + CO}{CO_2 + CO + THC + Cp}$$

where $CO_2$ is the carbon dioxide concentration (ppmv), CO is the carbon monoxide concentration (ppmv), THC is the total hydrocarbon concentration (ppmv as methane), Cp is the particulate concentration (ppmv), all concentrations being measured at or over the flame of a flare. For example, currently in the United States the combustion efficiency of a flare should be at least 96.5% or the destruction efficiency should be at least 98%. Flare apparatuses are designed to achieve the desired combustion efficiency (e.g. at least 96.5%) with a net heating value in the combustion zone or a net heating value in the vent gas of at least a specific value. Currently in the United States for common flare designs this net heating value in the combustion zone is at least 270 BTU/SCF for steam-assisted flares or at least 22 BTU/SQF on a dilution basis for air-assisted flares. The net heating value in the vent gas is at least 300 BTU/SCF. Efficiency of a flare is discussed in more detail in Marc McDaniel, *Flare Efficiency Study*, prepared for the U.S. Environmental Protection Agency EPA-600/2-83/052 (July 1983), and *Parameters for Properly Designed and Operated Flares*, U.S. Environmental Protection Agency Office of Air Quality Planning and Standards (April 2012), each of which is incorporated by reference. Applicable regulations are also found in Title 40 of the Code of Federal Regulations, Parts 60 and 63.

Figure 2:
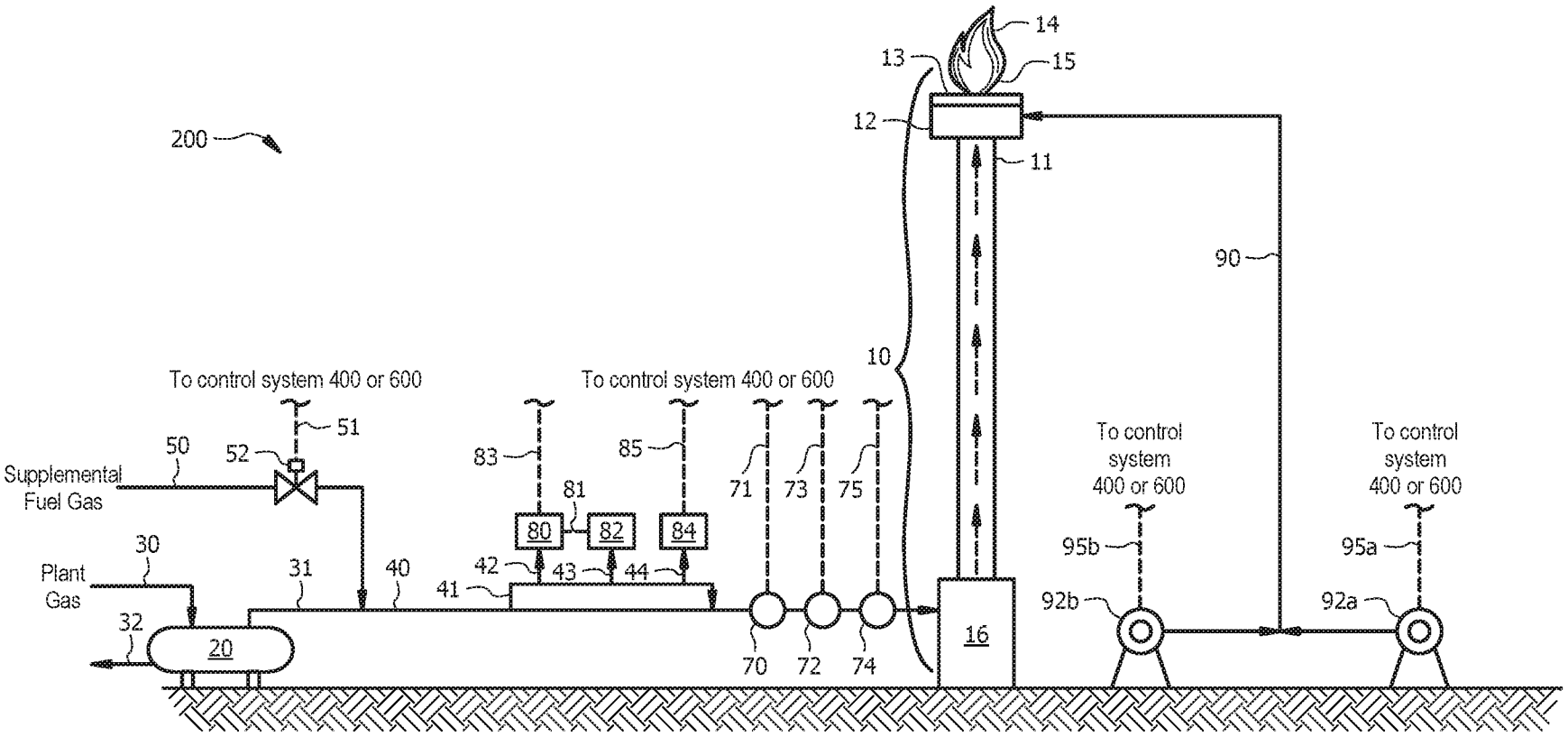
FIG. 2 illustrates a flare apparatus for air-assisted flaring.

FIG. 1 illustrates a flare apparatus 100 for steam-assisted flaring. FIG. 2 illustrates a flare apparatus 200 for air-assisted flaring.

The flare apparatus 100 of FIG. 1 and the flare apparatus 200 of FIG. 2 can include a flare 10. The flare 10 can have a flare stack 11, an injection manifold 12, a flare tip 13, and a flame 14 for combustion of flammable components in a combustion zone 15 of the flare 10. The flare 10 can optionally include a liquid seal 16 connected to the vent gas stream 40 and to the flare stack 11. The liquid seal 16 can be embodied as a vessel containing a liquid such as water. The liquid seal 16 can receive the vent gas from the vent gas stream 40, and the vent gas can bubble upward through the liquid in the liquid seal 16 and then flow into the flare stack 11. FIG. 1 and FIG. 2 show the liquid seal 16 being under the flare stack 11. In an alternative aspect, the liquid seal 16 is a vessel that is separate from the flare stack 11 and can either be placed on the ground next to flare stack 11 or at a desired distance from the flare stack 11. In both cases, the liquid seal 16 and the flare stack 11 can be fluidly connected such that vent gas that bubbles up through the liquid in the liquid seal 16 can pass to the flare stack 11, for example, via a gas conduit. In the event that the flame 14 spreads downwardly into the flare stack 11, the liquid seal 16 can prevent the flames from moving into the vent gas stream 40 and further back into the streams which feed to the flare 10.

The flare 10 can include other equipment such as an enclosure for the flame 14, wind deflectors, a gas barrier, and a pilot (discussed herein as part of the injection manifold 12). Examples of the components and equipment which can be included with the flare 10 are discussed in Adam Bader et al., *Selecting the Proper Flare Systems*, CEP, July 2011 at 45 and KLM Technology Group, *Kolmetz Handbook of Process Equipment Design, Flare Systems Safety, Selection and Sizing*, Rev:01 pages 1-19 (2007), each of which is incorporated herein by reference.

The combustion zone 15 of the flare 10 is the portion of the flame 14 at the flare tip 13 where the gas received from the vent gas stream 40 is combined with steam or air and combusted. When using steam for efficient combustion, control of a net heating value (NHV) in the combustion zone 15 is maintained at a minimum regulated value (e.g., 270 BTU/SCF). When using air for efficient combustion, control of a net heating value (NHV) on a dilution basis in the combustion zone 15 is maintained at a minimum regulated value (e.g., 22 BTU/SQF). These values for the minimum regulated value for steam or air are based on current regulations, and the values are subject to change according to jurisdiction and over time.

The flare 10 can generally receive the vent gas for combustion via the liquid seal 16. For flares not utilizing the liquid seal 16, the flare 10 can receive a vent gas for combustion at a point along the flare stack 11, for example, near ground level at the bottom of the flare stack 11. The received gas bubbles upwardly through any liquid in the liquid seal 16, and the gas rises upwardly in the flare stack 11, with or without gas blower assistance within the flare stack 11. The received gas can flow from the flare stack 11 into the combustion zone 15 of the flare 10.

The injection manifold 12 can have any configuration of piping and nozzles for feeding steam or air to the combustion zone 15 so as to atomize the vent gas and blend the vent gas with steam or air for combustion at the flare tip 13. The flare tip 13 can be configured to include an injection manifold 12 and a flare tip 13 that generates the flame 14 for the combustion zone 15. The injection manifold 12 and flare tip 13 can also include an ignition system which can initiate and maintain combustion of the vent gas in a stable manner. The ignition system can have one or more pilots, pilot igniters, pilot flame detectors, and apparatus to stabilize the pilot. In an aspect, the injection manifold 12 and the flare tip 13 can have one or more apparatus to stabilize the flame 14. A discussion of an ignition system, injection manifold 12, and flare tip 13 can be found in Adam Bader et al., *Selecting the Proper Flare Systems*, CEP, July 2011 at 45, which is incorporated herein by reference. The gas to be combusted (e.g., the vent as) can pass from the flare stack 11, through the injection manifold 12, to the flare tip 13 and into the flame 14. In an aspect, combustion and blending can occur simultaneously in the combustion zone 15.

In both flare apparatuses 100 and 200, a vent gas containing flammable components can feed to the flare 10 via a vent gas stream 40 connected to the flare 10 at or near the bottom of the flare stack 11, e.g., via the liquid seal 16. The point at which the vent gas is fed to the flare 10 is not limited by this disclosure and can feed at any location on the flare 10 which is upstream of the combustion zone 15.

The vent gas can be sourced from at least one gas stream in a plant (e.g., a plant gas stream) which is suitable for flaring (combustion). In particular aspects, the plant gas stream can be recovered from at least part of a stream from a cracking unit, a natural gas liquid facility, a polymer production facility, a poly alpha olefin (PAO) plant, a normal alpha olefin (NAO) plant, a reformer, a catalytic cracker, an alkylation process, any other petrochemical process, or refining process incorporating a flammable hydrocarbon, or a combination thereof. As discussed in more detail below, a knockout pot (e.g., see knockout pot 20 in FIGS. 1 and 2) can be configured to receive the plant gas, and to recover the vent gas stream 40 containing the vent gas from the plant gas.

The vent gas can include a wide variety of gaseous components, typically organic gases, inorganic gases, and any other gases which are present in a cracking unit, a natural gas liquid facility, a polymer production facility, a poly alpha olefin (PAO) plant, a normal alpha olefin (NAO) plant, a reformer, a catalytic cracker, an alkylation process, any other petrochemical process, or refining process incorporating a flammable hydrocarbon, or a combination thereof. Examples of components of the vent gas in the vent gas stream 40 include one or more of $C_1$-$C_{20}$ hydrocarbons, nitrogen, carbon monoxide, carbon dioxide, water (as vapor or steam), hydrogen, hydrogen sulfide, hydrogen cyanide, ammonia, amine, a molecule containing HC+N, a molecule containing +O, a molecule containing +S, or a combination thereof. The vent gas can also include added supplemental fuel gas (e.g., fuel gas or natural gas) which is added to raise the net heating value of the vent gas in the vent gas stream 40 for combustion in the flare 10. Addition of the supplemental fuel gas is described in more detail below.

Figure 3:
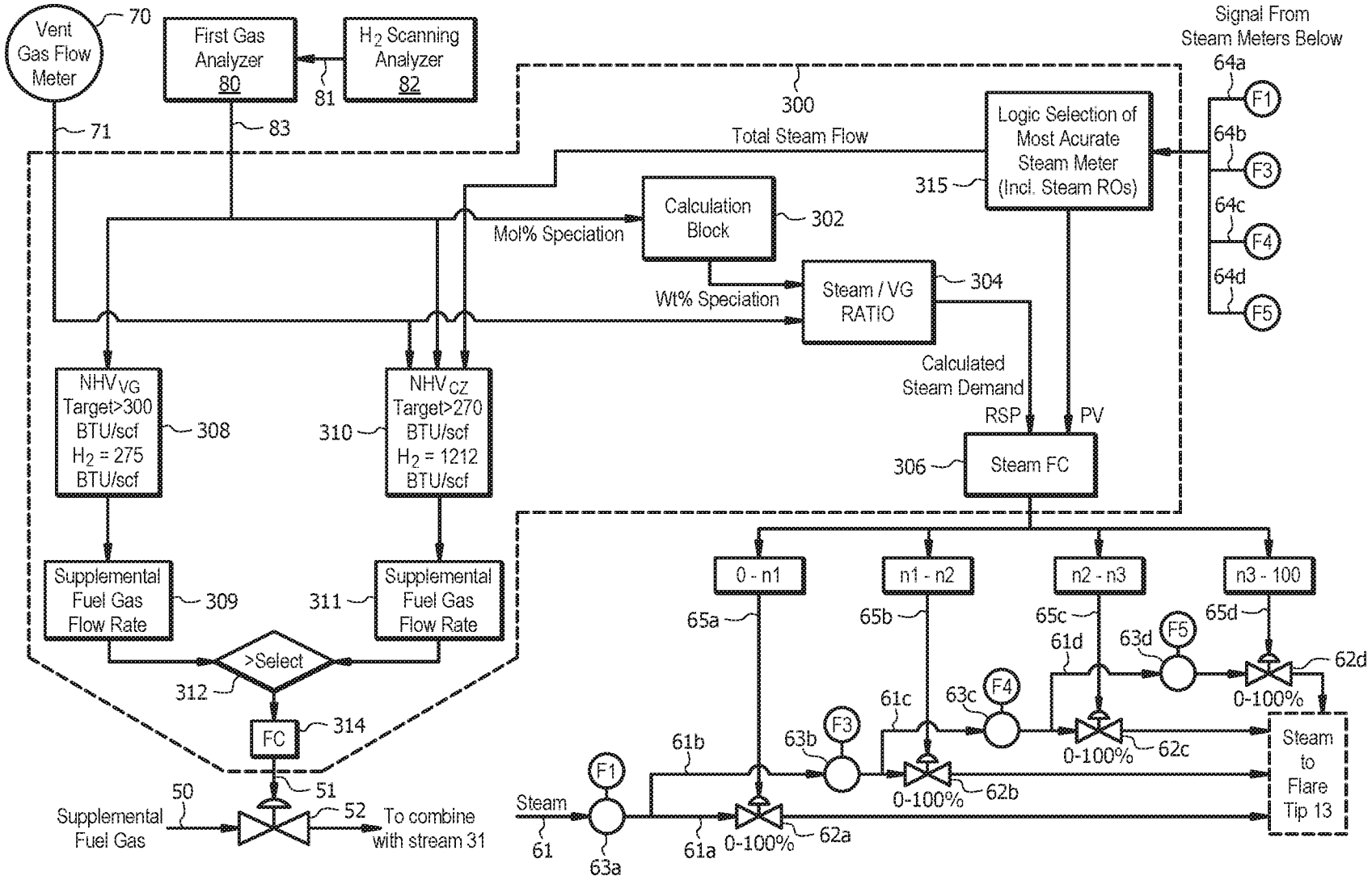
FIG. 3 illustrates a detailed view of a flare control system that can be utilized in the apparatus of FIG. 1.
Figure 5:
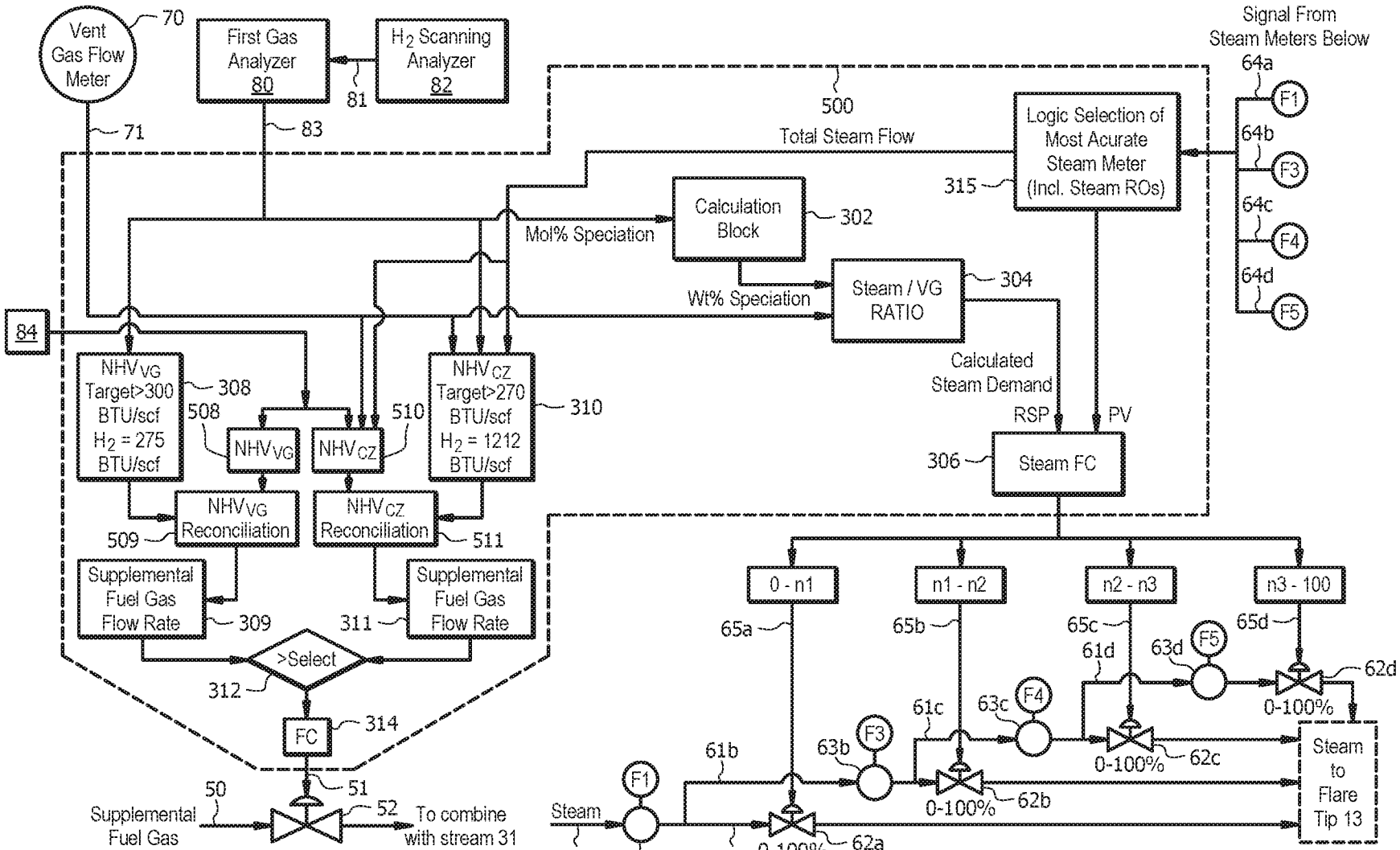
FIG. 5 illustrates a detailed view of another flare control system that can be utilized in the apparatus of FIG. 1.

Efficient operation of the flare 10 can be achieved by controlling the flow of steam in the flare apparatus 100 of FIG. 1 using flare control system 300 of FIG. 3 or the flare control system of FIG. 5. Steam can feed to the injection manifold 12 via stream 60. Stream 60 is fluidly connected to a plurality of steam lines 61*a*, 61*b*, 61*c*, and 61*d*, all being fed steam by a steam supply line 61. Each of the plurality of steam lines 61*a*, 61*b*, 61*c*, and 61*d* comprises a corresponding steam flow control valve 62*a*, 62*b*, 62*c*, and 62*d* and a corresponding steam flow meter 63*a*, 63*b*, 63*c*, and 63*d*, all being fed steam by the steam supply line 61. The corresponding steam flow control valves 62*a*, 62*b*, 62*c*, and 62*d* can be used to control the flow of steam to the flare 10 via the plurality of steam lines 61*a*, 61*b*, 61*c*, and 61*d*. Each of the corresponding steam flow control valves 62*a*, 62*b*, 62*c*, and 62*d* can be the same or different from one another. In an aspect, one or more of the steam flow control valves 62*a*, 62*b*, 62*c*, and 62*d* can be of different sizes. In an aspect, each of the corresponding steam flow control valves 62*a*, 62*b*, 62*c*, and 62*d* can be networked or linked to the flare control system (e.g., flare control system 200 in FIG. 3 or flare control system 500 in FIG. 5). While four steam lines 61*a-d*, four steam flow control valves 62*a-d*, and four steam flow meters 63*a-d* are shown in FIG. 1, it is contemplated that any other arrangement or number of lines, valves, and meters can be linked to and controlled by the flare control system 200 or flare control system 500. That is, the arrangement of four steam lines 61*a-d*, four steam flow control valves

62*a-d*, and four steam flow meters 63*a-d* in FIG. 1 is exemplary and it is not intended that the disclosure is limited to this arrangement.

FIG. 1 shows the plurality of steam lines 61*a*, 61*b*, 61*c*, and 61*d* are arranged in a cascade fashion. In the cascade fashion, steam lines 61*b*, 61*b*, 61*c*, and 61*d* each comprises a portion of steam from steam supply line 61. Each of the plurality of steam lines 61*a*, 61*b*, 61*c*, and 61*d* flows to stream 60 which feeds steam to the injection manifold 12 of the flare 10.

The steam flow meters 63*a*, 63*b*, 63*c*, and 63*d* can have a reading accuracy of +/−5%.

Figure 4:
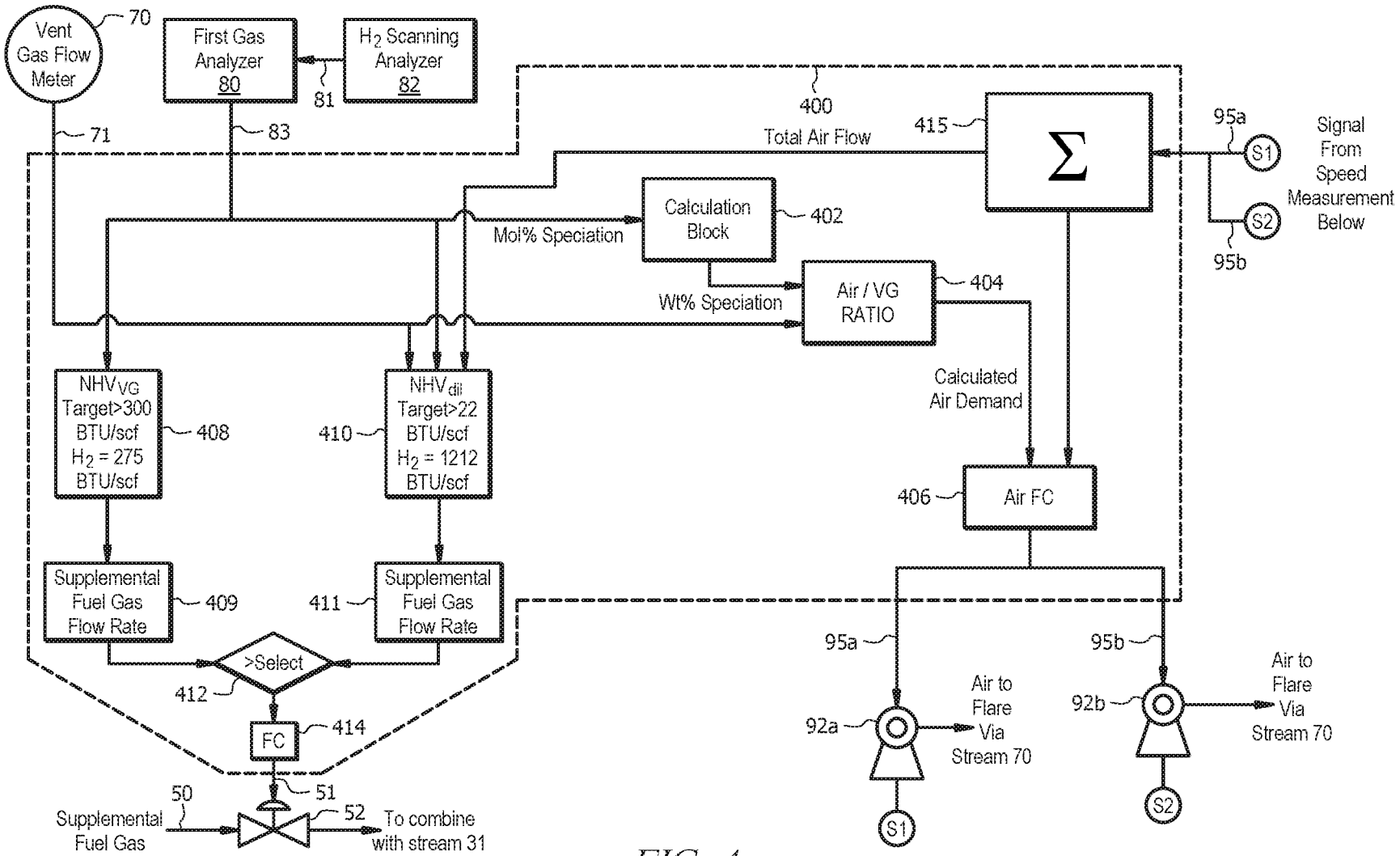
FIG. 4 illustrates a detailed view of a flare control system that can be utilized in the apparatus of FIG. 2.

Efficient operation of the flare 10 can be achieved by controlling the flow of air in the flare apparatus 200 of FIG. 2 using flare control system 400 of FIG. 4 or the flare control system 600. Air can feed to the flare 10 via stream 90. The blowers 92*a* and 92*b* can be equipment known in the art for moving air at a desired speed to the flare 10 via stream 90. In an aspect, the blowers 92*a* and 92*b* can each have a variable frequency drive (VFD) motor controller that can adjust the speed of an electric motor of each of the blowers 92*a* or 92*b* by varying the frequency and voltage. The flare control system 400 or flare control system 600 can be linked with the VFD motor controller of the blowers 92*a* and 92*b* so as to control the flow of the air to the flare 10. Blower curves, which include data for motor speed (RPM) versus corresponding flow of air, can be used by the flare control system 400 or flare control system 600 to relate which speed needs to be used in order to achieve a particular air flow.

The flare control system 400 and the flare control system 600 can operate and control the first blower 92*a* across a range of speeds for desired air flow rates and additionally operate and control the second blower 92*b* for additional air flow. FIG. 2 shows the blowers 92*a* and 92*b* in parallel arrangement for feeding air to stream 90. While the two blowers 92*a* and 92*b* are shown in parallel arrangement in FIG. 2, it is understood that the configuration shown in FIG. 2 is exemplary and the disclosure contemplates any other number and arrangement of blowers which can be linked to and controlled by the flare control system 400 or the flare control system 600.

Each flare apparatus 100 and 200 can include a first gas analyzer 80 coupled to the vent gas stream 40. The first gas analyzer 80 can be configured to analyze the vent gas in a sample stream formed by lines 41 and 42 taken from the vent gas stream 40. FIG. 1 and FIG. 2 show the sample stream formed by lines 41 and 42 can be coupled to the vent gas stream 40 and configured to pass a portion of the vent gas from the vent gas stream 40 to the first gas analyzer 80 for analysis of the composition of the vent gas. The sample stream formed by lines 41 and 42 can be configured to minimize any delay in passing the sample of vent gas to the first gas analyzer 80. Alternatively, the first gas analyzer 80 can be configured to analyze the vent gas in a flow path of the vent gas in the vent gas stream 40.

In an aspect, the first gas analyzer 80 can be an online tunable infrared absorption based gas analyzer. An example of an online tunable infrared absorption based gas analyzer is the SpectraScan 2400 manufactured by MDS Instruments, Inc. and packaged and certified by SERVOMEX™. In alternative aspects, the first gas analyzer 80 can be a mass spectrometer or a gas analyzer that utilizes Raman analytical technology. An examples of mass spectrometers include AMETEK™ FlarePro, EXTREL™ Max300-RTG, and THERMO FISHER SCIENTIFIC™ Prima Pro. An example of a gas analyzer that utilizes Raman analytical technology is the IMACC Ramanl.

The first gas analyzer 80 can be configured to measure a concentration of at least one hydrocarbon of the vent gas in the sample stream formed by lines 41 and 42 taken from the vent gas stream 40. In some aspects, the first gas analyzer 80 can identify other gas components in the vent gas stream 40 and their respective concentration. The frequency of measurement of the concentration by the first gas analyzer 80 can be on the order of seconds, for example, every 5 to 6 seconds, or otherwise an amount of time which corresponds to the measurement and analysis time for an online tunable infrared absorption based gas analyzer. The at least one hydrocarbon for which concentration is measured by the first gas analyzer 80 includes one or more of $C^1$-$C_{20}$ hydrocarbons; alternatively, $C^1$-$C_6$ hydrocarbons. Other gas components for which concentration can be measured include, but are not limited to, one or more of CO and $H_2S$. The first gas analyzer 80 can communicate with the flare control system 300, 400, 500, or 600 via any suitable communication protocol, e.g., a Modbus TCP/IP protocol.

In aspects, the first gas analyzer 80 can be coupled via communication line 81 to a hydrogen scanning analyzer 82. The hydrogen scanning analyzer 82 can be configured to analyze the vent gas in a sample stream formed by lines 41 and 43 taken from the vent gas stream 40. The sample stream formed by lines 41 and 43 can be coupled to the vent gas stream 40 in a location which is upstream or downstream of the location where the sample stream formed by lines 41 and 42 is located. Alternatively, the hydrogen scanning analyzer 82 can be configured to analyze the vent gas in a flow path of the vent gas in the vent gas stream 40. The hydrogen scanning analyzer 82 can measure a hydrogen concentration in the vent gas in a sample stream formed by lines 41 and 43 taken from the vent gas stream 40 in real-time (e.g., every 5-6 seconds). The hydrogen scanning analyzer 82 can communicate the concentration of hydrogen to the first gas analyzer 80 via any suitable communication protocol, e.g., a 4-20 mA signal via communication line 81. In turn, the first gas analyzer 80 can ascertain the concentration of the at least one hydrocarbon, as well as other gaseous components including, for example, CO, $H_2S$, and hydrogen on a mol % basis. Alternatively, the hydrogen scanning analyzer 82 can communicate the concentration of hydrogen directly to the flare control system 300, 400, 500, or 600 via any suitable communication protocol (not shown on FIG. 1 or FIG. 2). The first gas analyzer 80 can communicate with flare control system 300, 400, 500, or 600 via communication line 83 the concentration of the at least one hydrocarbon, as well as other gaseous components. The flare control system 300, 400, 500, or 600 can control, in real-time based at least in part on the hydrogen concentration in the vent gas stream 40, the flow of steam or air to the flare 10, respectively. An example of a hydrogen scanning analyzer 82 is the HY-OPTIMA™ 2700 Series manufactured by SERVOMEX™. The HY-OPTIMA™ 2700 Series is an example of an explosion-proof in-line hydrogen gas analyzer which uses a solid-state, non-consumable thin film palladium-nickel alloy-based lattice sensor to measure a hydrogen concentration in the vent gas stream 40, in real-time.

Each flare apparatus 100 and 200 can optionally include a second gas analyzer 84 coupled to the vent gas stream 40. The second gas analyzer 84 can be configured to analyze the vent gas in a sample stream formed by lines 41 and 44 taken from the vent gas stream 40. FIG. 1 and FIG. 2 show the sample stream formed by lines 41 and 44 can be coupled to the vent gas stream 40 and can be configured to pass a portion of the vent gas stream 40 to the optional second gas analyzer 84 for analysis of the composition of the vent gas in the vent gas stream 40. The sample stream formed by lines 41 and 44 can be configured to minimize any delay in passing the sample of vent gas to the second gas analyzer 84. The sample stream formed by lines 41 and 44 can be coupled to the vent gas stream 40 in a location which is upstream or downstream of the location where the sample stream formed by lines 41 and 42 and/or the location where the sample stream formed by lines 41 and 43 is located. Alternatively, the second gas analyzer 84 can be configured to analyze the vent gas in a flow path of the vent gas in the vent gas stream 40. In an aspect, the second gas analyzer 84 can be a gas chromatograph (GC). Gas chromatographs for sampling process streams are known in the art and commercially available. The second gas analyzer 84 can be configured to measure a concentration of at least one hydrocarbon of the vent gas in sample stream formed by lines 41 and 44 taken from the vent gas stream 40. The frequency of measurement of the concentration by the second gas analyzer 84 can be on the order of magnitude of minutes, for example, every 7 to 10 minutes, or otherwise an amount of time which corresponds to the measurement and analysis time for a gas chromatograph. The primary purpose of the gas chromatograph is for reporting of vent gas composition to regulatory agencies, since at least for some regulatory agencies, gas chromatography is the standard technique for reporting.

In aspects, the gas analyzers 80, 82, and 84 can be housed in an enclosure (e.g., a building or equipment enclosure), and at least a portion of each of the sample lines 41/42, 41/43, 41/44 can also be configured to connect to the gas analyzers 80, 82, and 42 in the enclosure. The sample lines 41/42, 41/43, 41/44 can be configured to include gas conditioning equipment including filtration devices which remove particulate materials and other materials found in the vent gas stream 40 which can damage the gas analyzers 80, 82, and 84. The conditioning equipment of the sample lines 41/42, 41/43, 41/44 can also include pressure and heating devices which keep the vent gas in the sample lines 41/42, 41/43, 41/44 at suitable pressure, temperature, and flow rate for measurement and analysis.

In an alternative aspect, the gas analyzers 80 and 82 can be housed in a first enclosure, and the second gas analyzer 84 can be housed in a second enclosure. Sample line 41 can be appropriately configured to flow to each of the gas analyzers 80, 82, and 84 in their respective enclosures.

While FIG. 1 and FIG. 2 illustrate that the first gas analyzer 80 and the hydrogen scanning analyzer 82 are upstream of the second gas analyzer 84, relative to the flow of the sample line 41, it is contemplated that the second gas analyzer 84 can be upstream of the first gas analyzer 80 and the hydrogen scanning analyzer 82.

As can be seen in FIG. 1 and FIG. 2, line 41 which forms part of each sample stream can be configured to pass the remaining vent gas from which samples are taken back to the vent gas stream 40. The configuration of line 41 is in FIG. 1 and FIG. 2 is shown for clarity, and it is contemplated that different configurations can be used and that line 41 can include appropriate equipment such as valves, instrumentation, and gas pumps.

Each flare apparatus 100 and 200 can also include a vent gas flow meter 70 to measure a velocity of the vent gas in the vent gas stream 40. In an aspect, the vent gas flow meter 70 can be an ultrasonic flow meter or an optical flow sensor. The vent gas flow meter 70 can communicate with the flare control system 300, 400, 500, or 600 through a communication line 71. Each flare apparatus 100 and 200 can also include one or more vent gas temperature sensors 72 to measure a temperature of the vent gas in the vent gas stream 40. The vent gas temperature sensor(s) 72 can communicates with the flare control system 300, 400, 500, or 600 through communication line 73. Each flare apparatus 100 and 200 can also include one or more vent gas pressure sensors 74 to measure a pressure of the vent gas in the vent gas stream 40. The vent gas pressure sensor(s) 74 communicates with the flare control system 300, 400, 500, or 600 through communication line 75. The temperature sensor(s) 72 and pressure sensor(s) 74 may be placed directly in the vent gas stream 40 or may be placed in equipment connected to the vent gas stream 40 having capability of measuring the actual temperature and pressure of the vent gas in the vent gas stream 40.

The vent gas stream 40 comprises a raw vent gas recovered from a plant gas stream 30 and optionally a supplemental fuel gas added to the raw vent gas via supplemental fuel gas stream 50. Stated another way, each flare apparatus 100 and 200 can also include a supplemental fuel gas stream 50 which can combine with a raw vent gas in line 31 to form the vent gas in the vent gas stream 40. The supplemental fuel gas can be obtained from the supplemental fuel gas stream 50, and the raw vent gas is recovered from a plant gas stream 30. One or both of these supplemental fuel gases can be used to increase the net heating value (NHV) of the vent gas in the vent gas stream 40 for appropriate combustion in the flare 10.

Each flare apparatus 100 and 200 can include at least one knockout pot 20. The knockout pot 20 can be of any typical configuration found in a petrochemical plant or refinery, for example, a horizontal cylindrical shape configured to separate liquid from gas, where gas exits the top of the knockout pot 20. The knockout pot 20 can be configured to receive a plant gas in plant gas stream 30 (the plant gas stream 30 can interchangeably be referred to as the flare header of the flare 10), and to recover a raw vent gas stream 31 from the plant gas stream 30. The separated liquid can flow from the knockout pot 20 in liquid stream 32. The knockout pot 20 can have any configuration known in the art for recovering the vent gas stream 31. Additionally, the flare apparatus 100 and 200 can have more than one knockout pot configured similarly to knockout pot 20 and configured to recover other raw vent gases from other plant gas streams. The other raw vent gases can be combined into stream 31 along with the raw vent gas recovered from knockout pot 20 to be collectively referred to as the recovered raw vent gas in stream 31 which is optionally combined with the supplemental fuel gas stream 50 to form the vent gas that flows in the vent gas stream 40. Within the scope of this disclosure, it is contemplated that the flare 10 can additionally include a side knockout pot fluidly connected to the flare stack 11. The side knockout pot can be configured with piping which receives condensed vapors from the flare stack 11 and recovers additional gas from the condensed vapors for combustion in the flare 10. The knockout pot 20 within the scope of this disclosure does not include the side knockout pot of the flare 10.

In aspects, the knockout pot 20 can be located in a cracking unit, a natural gas liquid facility, a polymer production facility, a poly alpha olefin (PAO) plant, a normal alpha olefin (NAO) plant, a reformer, a catalytic cracker, an alkylation process, any other petrochemical process, or refining process incorporating a flammable hydrocarbon, or a combination thereof.

Flare apparatus 100 includes a flare control system 200 or 500 networked with the first gas analyzer 80, the hydrogen scanning analyzer 82, the optional second gas analyzer 84, the plurality of steam flow control valves **62*a*-62*d*, the vent gas flow meter 70, the vent gas temperature sensor 72, the vent gas pressure sensor 74, and the supplemental fuel gas flow control valve 52 for the supplemental fuel gas stream 50. The networking of the flare control system 200 or 500 with the first gas analyzer 80, the hydrogen scanning analyzer 82, the optional second gas analyzer 84, the plurality of steam flow control valves 62***a*-62*d*, the plurality of steam flow meters 63*a*-63*d*, the vent gas flow meter 70, the vent gas temperature sensor 72, the vent gas pressure sensor 74, and the supplemental fuel gas flow control valve 52 can include any suitable actuation technique and/or networking technique. Networking techniques can include wired networking (e.g., local area network, wide area network, or proprietary LAN) and wireless networking (e.g., Bluetooth, Wi-Fi) via communication lines 51, 64*a*-64*d*, 65*a*-65*d*, 71, 73, 75, 83, and 85.

The flare control system 200 or 500 can be embodied with computer equipment such as one or more processors, memory, datastores, networking cards, and other equipment for processing data (e.g., sending/receiving messages containing data). Processors, memory, and datastores can be distributed among several computer devices or located in a single computer device.

In operation, the flare control system 200 can read measurements from one or any combination of the steam flow meters 63*a*, 63*b*, 63*c*, and 63*d* across the entire operating range of flow rates in order to open or close any one or combination of the plurality of steam flow control valves 62*a*, 62*b*, 62*c*, and 62*d* to achieve the required flow of steam determined by the flare control system 200 or 500.

The control scheme of the flare control system 200 is explained in more detail in the description for FIG. 3, and the control scheme of the flare control system 500 is explained in more detail in the description for FIG. 5.

Flare apparatus 200 includes a flare control system 400 or 600 coupled with the first gas analyzer 80, the hydrogen scanning analyzer 82, the optional second gas analyzer 84, the blowers 92*a* and 92*b*, the vent gas flow meter 70, the vent gas temperature sensor 72, the vent gas pressure sensor 74, and the supplemental fuel gas flow control valve 52 for the supplemental fuel gas stream 50. The networking techniques of the flare control system 400 or 600 with the first gas analyzer 80, the hydrogen scanning analyzer 82, the optional second gas analyzer 84, the blowers 92*a* and 92*b*, the vent gas flow meter 70, the vent gas temperature sensor 72, the vent gas pressure sensor 74, and the supplemental fuel gas flow control valve 52 can include any suitable actuation technique and/or networking technique. Networking techniques can include wired networking (e.g., local area network, wide area network, proprietary LAN) and wireless networking (e.g., Bluetooth, Wi-Fi) via communication lines 51, 71, 73, 75, 83, 85, and 95*a*-95*b*.

The flare control system 400 or 600 can be embodied with computer equipment such as one or more processors, memory, datastores, networking cards, and other equipment for processing data (e.g., sending/receiving messages containing data). Processors, memory, and datastores can be distributed among several computer devices or located in a single computer device.

In operation, the flare control system 400 or 600 can communicate through communication lines 95*a* and 95*b* with the VFD motor controller of any of the blowers 92*a* and 92*b* to determine the speed of the blowers 92*a* and 92*b*. The flare control system 400 or 600 can then determine the flow rate of air to the flare 10 and determine whether the flow rate of air needs to be adjusted to a new required flow rate. The flare control system 400 or 600 can then communicate with the VFD motor controller of the blowers 92*a* and 92*b* to adjust the speed of an electric motor of each of the blowers 92*a* or 92*b* by varying the frequency and voltage, in order to achieve the required flow of air determined by the flare control system 400 or 600.

The control scheme of the flare control system 400 is explained in more detail in the description for FIG. 4. The control scheme of the flare control system 600 is explained in more detail in the description for FIG. 6.

In aspects of the flare apparatus 100 and flare apparatus 200, the flow of the supplemental fuel gas stream 50 can be controlled via supplemental fuel gas control valve 52, which is controlled by the flare control system 300, 400, 500, or 600. These aspects include controlling, in real-time based at least in part on the concentration of the at least one hydrocarbon measured by the first gas analyzer 80, a flow of a supplemental fuel gas (e.g., natural gas or fuel gas) into the vent gas stream 40. The control of the supplemental fuel gas so as to combine with the raw vent gas stream 31 to form the vent gas stream 40 is not manually performed. Put another way, the control of the supplemental fuel gas stream 50 via the supplemental fuel gas control valve 52 does not require manual control of the supplemental fuel gas control valve 52 at any time over the entire set of operating conditions of the flare 10 as compared with a flare apparatus not utilizing real-time control based at least in part on the concentration of at least one hydrocarbon measured by the first gas analyzer 80.

In general, addition of the supplemental fuel gas to the vent gas can maintain a minimum net heating value (NHV) in the resultant vent gas stream 40. When utilizing steam for efficient combustion, e.g., FIG. 1, the minimum NHV for the vent gas stream 40 required by current regulation is a minimum regulated value of 300 BTU/SCF), and the minimum NHV in the combustion zone 15 of the flare 10 required by current regulation is a minimum regulated value of 270 BTU/SCF. When utilizing air for efficient combustion, e.g., FIG. 2, the minimum NHV for the vent gas stream 40 required by current regulation is a minimum regulated value of 300 BTU/SCF, and the minimum NHV dilution parameter in combustion zone 15 required by current regulation is a minimum regulated value of 22 BTU/SQF. The minimum regulated value can differ by jurisdiction and can change over time. Thus, the minimum regulated values for NHV discussed herein are not intended to be limited to those currently in force or those in a single jurisdiction. To the extent different jurisdictions require different minimum regulated values for NHV, the scope of this disclosure is intended to include the applicable minimum regulated values for different jurisdictions.

The control scheme used in the flare control system 200 is now described in detail using FIG. 3. Reference numerals for components in FIG. 1 can be referred to in this discussion for clarity.

The flare control system 200 can be configured to control, in real-time based at least in part on the concentration of the at least one hydrocarbon, a flow of steam to the flare 10. With reference to FIG. 3, controlling a flow of steam to the flare 10 can include one or more of:

at block 302, calculating a molecular weight of the vent gas in the vent gas stream 40 using the concentration of the at least one hydrocarbon from the first gas analyzer 80 and the hydrogen scanning analyzer 82, and a molecular weight of the at least one hydrocarbon;

at block 304, measuring a velocity of the vent gas in the vent gas stream 40 using the vent gas flow meter 70;

at block 306, calculating a mass flow rate of the vent gas in the vent gas stream 40 using the measured vent gas velocity, the molar volume at standard conditions of 385.3 SCF/LB-MOL, and the calculated molecular weight;

at block 315, determining the current flow rate of steam to the flare using values obtained from steam flow meters 63*a*-63*d;* at block 304, calculating a total steam:vent gas mass ratio for efficient operation of the flare 10 using the concentration of the at least one hydrocarbon in the vent gas stream 40 multiplied by a standard steam:hydrocarbon ratio required for smokeless operation of the flare 10 for the at least one hydrocarbon;

at block 306, calculating a required steam flow rate for the flow of steam to the flare 10 using the total steam:vent gas ratio and the vent gas mass flow rate; and at block 306, adjusting the flow of steam to the flare 40 to the required steam flow rate.

In aspects, controlling a flow of steam to the flare 10 is not manually performed. In certain aspects, controlling a flow of steam to the flare 10 does not require manual control at any time over the entire set of operating conditions of the flare 10 as compared with a plant not utilizing the first gas analyzer 80 and/or which does not control the flow of steam in real-time.

The flare control system 200 can be configured to control a flow of the supplemental fuel gas in the supplemental fuel gas stream 50, which subsequently combines with the raw vent gas stream 31 to form the vent gas stream 40 by the flare control system 300. Controlling a flow of the supplemental fuel gas in the supplemental fuel gas stream 50 by the flare control system 200 can include one or more of:

at block 308, calculating a net heating value of the vent gas in the vent gas stream 40 using the concentration of the at least one hydrocarbon and a net heating value for the at least one hydrocarbon, wherein the concentration of the at least one hydrocarbon is measured by the first gas analyzer 80;

at block 309, calculating a first flow rate for the supplemental fuel gas that is required to change the net heating value of the vent gas in the vent gas stream 40 to meet a first setpoint value, wherein the first setpoint value is optionally defined as equal to or greater than a minimum net heating value for a vent gas specified by regulation;

at block 310, calculating a net heating value in the combustion zone 15 in the flare 10 using the flow rate of the vent gas in the vent gas stream 40, a flow rate of steam to the flare 10, and the calculated net heating value of the vent gas, wherein the flow rate of the vent gas is measured using the vent gas flow meter 70;

at block 311, calculating a second flow rate for the supplemental fuel gas that is required to change the net heating value in the combustion zone 15 to meet a second setpoint value, wherein the second setpoint value is optionally defined as equal to or greater than a minimum net heating value for a combustion zone specified by regulation;

at decision block 312, determining and selecting which one of the net heating value of the vent gas in the vent gas stream 40 and the net heating value for the combustion zone 15 is a selected net heating value that requires more supplemental fuel gas to meet the respective setpoint value (or alternatively stated, determining which one of the first flow rate and the second flow rate is greater, and identifying the one as a selected flow rate); and at block 314, adjusting the flow of supplemental fuel gas in the supplemental fuel gas stream 50 to the selected flow rate.

Algorithms and programming of the flare control system 200 in FIG. 3 are designated inside the dashed lines. The equipment of the flare apparatus 100, e.g., the vent gas flow meter 70, the first gas analyzer 80, the hydrogen scanning analyzer 82, the optional second gas analyzer 84, the supplemental fuel gas flow control valve 52, the steam flow meters 63*a*-63*d*, and the corresponding plurality of steam flow control valves 62*a*-62*d* are shown as networked with the flare control system 300.

A description of each variable and the associated units used in the equations to explain the functionality of the flare control system 200 are listed below:

D Pipe diameter, FT $Mol\%_{COMP\ n}$ Mole Percent of component 'n' in the vent gas stream $MW_{vg}$ Calculated molecular weight of the vent gas based on stream composition, LB/LB-MOL $NHV_{cz}$ Net heating value in the combustion zone, BTU/SCF, based on the combined heating value contributions of individual components in the vent gas steam, sweetening gas, and steam.

$NHV_{cz\ setpoint}$ Combustion zone net heating value setpoint, BTU/SCF $NHV_{sg}$ Net heating value of the sweetening gas, BTU/SCF $NHV_{vg}$ Net heating value of the vent gas stream, BTU/SCF $NHV_{vg\ setpoint}$ Vent gas net heating value setpoint, BTU/SCF $NHV_{COMP\ a}$ Net heating value of component 'n' in the vent gas stream, BTU/SCF $P_A$ Actual pressure, PSIG $P_S$ Standard pressure, 0 PSIG $Q_{sg,VOL}$ Flowrate of sweetening gas, MSCF/HR $Q_{s,MASS}$ Flowrate of steam, MLB/HR $Q_{s,req}$ Calculated required flowrate of steam, MLB/HR $Q_{s,VOL}$ Flowrate of steam, MSCF/HR $Q_{vg,MASS}$ Flowrate of vent gas, MLB/HR $Q_{vg,VOL}$ Flowrate of vent gas, MSCF/HR RSP Remote setpoint for controller $STM:VG_{Total}$ Required ratio of steam flow to total vent gas flow to maintain flame smokeless operation, LB/LB $STM:VG_{COMP\ n}$ Required ratio of steam to pure component 'n' to maintain smokeless operation, LB/LB $T_A$ Actual temperature, ° F.

$T_S$ Standard temperature, 68° F.

$V_{vg}$ Vent gas velocity in the main flare header, FT/SEC $Wt\%_{COMP\ n}$ Weight percent of component 'n' in the vent gas stream Controlling a flow of steam to the flare 10 can include calculating a molecular weight of the vent gas in the vent gas stream 40 using the concentration of the at least one hydrocarbon and a molecular weight of the at least one hydrocarbon. Recall the concentration at least one hydrocarbon and other gas components of the vent gas in the vent gas stream 40 are measured by the first gas analyzer 80 in units of mol %. The flare control system 200 can use the following equation to make the calculation for the total molecular weight of the vent gas in the vent gas stream 40:

$$MW_{vg} = \frac{\sum (mol\%_{comp\ n}) * (MW_{comp\ n})}{NF}.$$

Note that the above equation sums the multiple of the numerator value for the respective number "n" of components. The normalization factor, NF, is provided by the first gas analyzer 80 and is in units of mol %. In the absence of any needed normalization recommended by the first gas analyzer 80, a value of 1 is used for the normalization factor. Component molecular weights can be found in literature, and Table 1 below gives some example molecular weight values in units of LB/LB-MOL:

TABLE 1

| Component | Molecular Weight (LB/LBMOL) | Steam Ratio (LB steam/ LB component) | Target NHV (BTU/SCF) |
|---|---|---|---|
| Nitrogen | 28.01 | 0 | 0 |
| Water | 18.02 | 0 | 0 |
| Hydrogen | 2.02 | 0 | 274 (1212) |
| Methane | 16.04 | 0 | 896 |
| Ethane | 30.07 | 0.1-0.15 | 1595 |
| Propane | 44.10 | 0.25-0.3 | 2281 |
| Butane | 58.12 | 0.3-0.35 | 2957 |
| Pentane | 72.15 | 0.4-0.45 | 3655 |
| Ethylene | 28.05 | 0.4-0.5 | 1477 |
| Propylene | 42.08 | 0.5-0.6 | 2150 |
| Butene | 56.11 | 0.6-0.7 | 2928 |
| Butadiene | 54.09 | 0.9-1 | 2690 |
| Acetylene | 26.04 | 0.5-0.6 | 1404 |
| Benzene | 78.11 | 0.8-0.9 | 3591 |
| C5+ | 72.15 | 0.8-0.9 | 3655 |

The molecular weights and target NHV values in Table 1 can be found in the Federal Register at 80 Fed. Reg. 75178, 75271 (Dec. 1, 2015), which is incorporated herein by reference in its entirety. The required steam ratio for each component in Table 1 can be found, for example, in Pressure-relieving and Depressuring Systems, API Standard 521, $6^{th}$ Ed. (January 2014) at Table 14, which is incorporated herein by reference in its entirety. To the extent more than one value is given for the required steam ratio, the higher value can be used as the initial setpoint. In aspects, a net heating value of 274 BTU/SCF for hydrogen is used for calculating $NHV_{vg}$, and a net heating value of 1212 BTU/SCF for hydrogen is used for calculating $NHV_{cz}$. Additional information can be found in Petroleum Refinery Sector Risk and Technology Review and New Source Performance Standards, 79 Fed. Reg. 36,880 (Jun. 30, 2014) and 40 CFR 63.11(b)(ii), each of which is incorporated herein by reference in their entirety.

Controlling a flow of steam to the flare 10 can include measuring a velocity of the vent gas in the vent gas stream 40 using the vent gas flow meter 70. The vent gas flow meter 70 can be an ultrasonic flow meter configured to utilize a single set of ultrasonic transducers to measure the vent gas velocity, or it can be configured to measure vent gas velocity with two sets of ultrasonic transducers. In a two-set transducer configuration, the ultrasonic flow meter can further be configured to use both sets of transducers to generate an average velocity measurement with either a single range or a dual range (low-flow and high-flow) or to use a single set of transducers to measure a low-flow regime and the other set of transducers to measure a high-flow regime using two sets of probes. Other velocity measurement technologies suitable for measuring vent gas flow may also be applied to provide the vent gas velocity measurement. Such measurement technologies may include the OSI OFS-2000F™ velocity measurement device using optical scintillation technology.

Controlling a flow of steam to the flare 10 calculating a mass flow rate of the vent gas in the vent gas stream 40 using the measured vent gas velocity, the molar volume at standard conditions of 385.3 SCF/LB-MOL, and the calculatd molecular weight. In an aspect, this step can be performed in two sub-steps. First, the volumetric flow rate of the vent gas in the vent gas stream 40 can be calculated using the measured vent gas velocity. The flare control system 200 can use the following equation to make the calculation:

$$Q_{vg,VOL} = \left(V_{vg} * \pi\left(\frac{D}{2}\right)^2\right) * \left(\frac{(P_A + 14.696) * (T_S + 459.69)}{(P_S + 14.696) * (T_A + 459.69)}\right) * \frac{3600SEC/HR}{1000scf/Mscf}$$

where $Q_{vg,VOL}$ is the volumetric flow rate of the vent gas in the vent gas stream 40 in units of MSCF per hour. The variable description and units for $V_{vg}$, D, $p_A$, $T_A$, $p_S$, and $T_S$ are given above. $p_A$ and $T_A$ can be measured by temperature sensor(s) 72 and pressure sensor(s) 74 placed in the vent gas stream 40 or otherwise measured by equipment in the vent gas stream 40 having capability of measuring the actual temperature and pressure of the vent gas in the vent gas stream 40. Second, a mass flow rate of the vent gas in the vent gas stream 40 can be calculated using the calculated volumetric flow, the molar volume of 385.3 SCF/LB-MOL, and the calculated molecular weight. The flare control system 200 can use the following equation to make the calculation:

$$Q_{vg,MASS} = \left(\frac{Q_{vg,VOL}}{385.3\frac{SCF}{LB-MOL}}\right) * MW_{vg}.$$

where $Q_{vg,MASS}$ is the mass flow rate of the vent gas in the vent gas stream 40 in units of Mlb/hr per hour. The variable description and units for $Q_{vg,VOL}$ and $MW_{vg}$ are given above, and the molar volume at standard conditions of 385.3 SCF/LB-MOL is the molar volume used for the calculation.

Controlling a flow of steam to the flare 10 can include determining the current flow rate of steam to the flare 10 using values obtained from steam flow meters **63*a*-63*d*. Each of the steam flow meters 63*a*-63*d* can be networked to the flare control system 200 such that the signals from each of the steam flow meters 63*a*-63*d* communicate the signals via lines 64*a*-64*d*. In an aspect, the current flow can be determined in the flare control system 200 by logic selection of the most accurate steam flow meter 63*a*, 63*b*, 63*c*, 63*d***, or combinations thereof.

Controlling a flow of steam to the flare 10 can include calculating a total steam:vent gas mass ratio for efficient operation of the flare 10 using the concentration of the at least one hydrocarbon in the vent gas stream 40 multiplied by a standard steam:hydrocarbon ratio required for smokeless operation of the flare 10 for the at least one hydrocarbon. The flare control system 300 can use the following equation to make the calculation for the total steam:vent gas mass ratio, for example in block 304:

$$STM:VG_{Total} = \sum \frac{(Wt\%_{COMPn}) * (STM:VG_{COMPn})}{100 \text{ lb vent gas}}$$

The standard steam:hydrocarbon ratio for a particular component n, $STM:VG_{COMP\ n}$, is also available in literature with examples shown in Table 1 above. Alternatively, the standard steam:hydrocarbon ratio for component n can be determined by empirical testing a given flare by adding a set of known flow rates of component n to the vent gas and adjusting the steam flow to determine the required steam flow to control smoke formation for each known flow rate of component n.

The wt $\%_{COMP\ n}$ is the weight percent of a particular component n in the vent gas stream 40 obtained by converting the mol % concentration data measured by the first gas analyzer 80 to wt % using the following equation:

$$\mathrm{Wt}\%_{COMPn} = \frac{(Mol\%_{COMPn}) * (\mathrm{MW}_{COMPn})}{(NF) * (\mathrm{MW}_{vg})}.$$

The mol $\%_{COMP\ n}$ is the concentration of component n in units of mol % provided by the first gas analyzer 80. The $\mathrm{MW}_{COMP\ n}$ is the molecular weight of component n taken from information available in literature (examples shown in Table 1 above). The normalization factor, NF, is provided by the first gas analyzer 80 and is in units of mol %. In the absence of any needed normalization recommended by the first gas analyzer 80, a value of 1 is used for the normalization factor.

Controlling a flow of steam to the flare 10 can include calculating a required steam flow rate for the flow of steam to the flare 10 using the total steam:vent gas mass ratio and the total mass flow rate of the vent gas in the vent gas stream 40. The flare control system 200 can use the following equation to make the calculation, for example in block 308:

$$Q_{s,req} = (STM{:}\ VG_{Total}) * (Q_{vg,MASS})$$

The variables used to calculate the required steam flow rate are explained above.

Controlling a flow of steam to the flare 10 can include adjusting the flow of steam to the flare 40 at the required steam flow rate, $Q_{s,req}$. In some aspects, the input needed for the steam flow control valves 62*a-d* is in volumetric flowrate. In these aspects, the mass-basis flow rate of steam in the value for $Q_{s,req}$ can be converted to a volumetric basis for the steam flow rate setpoint using the following equation, for example in block 306:

$$Q_{s,VOL} = \frac{Q_{s,MASS} * 385.3 \frac{SCF}{\mathrm{LB} - MOL}}{18.02 \frac{\mathrm{LB}}{\mathrm{LB} - MOL}}.$$

The flare control system 200 can adjust the steam flow control valves 62*a*-62*d* to achieve the value calculated for $Q_{s,VOL}$.

Controlling a flow of a supplemental fuel gas in supplemental fuel gas stream 50 can include calculating a net heating value of the vent gas in the vent gas stream 40 using the concentration of the at least one hydrocarbon and a net heating value for the at least one hydrocarbon. The flare control system 200 can use the following equation to make the calculation:

$$NHV_{vg} = \frac{\sum (mol\%_{comp\,n}) * (NHV_{comp\,n})}{100}$$

where mol $\%_{comp\ n}$ is the concentration of component "n" in the vent gas stream 40 measured by the first gas analyzer 80 and $\mathrm{NHV}_{comp\ n}$ is the net heating value of the component "n" which is available in the literature and examples for certain gasous components are provided in Table 1 above. Calculating a net heating value of the vent gas in the vent gas stream 40 can also utilize the concentration of hydrogen in the vent gas of the vent gas stream 40 based on the hydrogen scanning analyzer 82. FIG. 3 shows that a value of 275 BTU/SCF should be used for the NHV of hydrogen when calculating the contribution of any measured hydrogen to the overall net heating value of the vent gas in the vent gas stream 40, $\mathrm{NHV}_{vg}$.

Controlling a flow of a supplemental fuel gas in the supplemental fuel gas stream 50 can include measuring a flow rate of the vent gas in the vent gas stream 40 with the vent gas flow meter 70. The flow rate, $Q_{vg,VOL}$, can be the volumetric flow rate, which is described using the equation for $Q_{vg,VOL}$ above. To obtain the $Q_{vg,VOL}$, $V_{vg}$ (the velocity of the vent gas in the vent gas stream 40) is obtained. The value of $V_{vg}$ (the velocity of the vent gas in the vent gas stream 40) can be obtained as described above.

Controlling a flow of a supplemental fuel gas in supplemental fuel gas stream 50 can include calculating a net heating value in a combustion zone 15 in the flare 10 using the flow rate of the vent gas in the vent gas stream 40, a flow rate of steam to the flare 10, and the calculated net heat value for the vent gas. The flare control system 200 can use the following equation to make the calculation, for example in block 310:

$$NHV_{CZ} = \frac{Q_{vg,VOL} * NHV_{vg}}{Q_{vg,VOL} + Q_{s,VOL}}.$$

The net heating value in the combustion zone 15, $\mathrm{NHV}_{cz}$, uses the values for $\mathrm{NHV}_{vg}$ and $Q_{vg,VOL}$ which are discussed above. This equation also includes the term Qs,vol, which is calculated as explained above when calculating the required steam flow rate on a volumetric flow rate basis. The term Qs,vol, is used to account for the dilution effect of the steam on the net heating value in the combustion zone 15, $\mathrm{NHV}_{cz}$. FIG. 3 shows that a value of 1,212 BTU/SCF should be used for the NHV of hydrogen when calculating the contribution of any measured hydrogen to the overall net heating value in the combustion zone 15, $\mathrm{NHV}_{cz}$.

Controlling a flow of a supplemental fuel gas in supplemental fuel gas stream 50 can include, at block 309, calculating a first flow rate for the supplemental fuel gas that is required to change the net heating value of the vent gas in the vent gas stream 40 to meet a first setpoint value, wherein the first setpoint value is equal to or greater than a first target net heating value for a vent gas specified by regulation. As discussed herein, the first target value for NHV required by regulation for the vent gas in the vent gas stream 40 is currently a minimum value of 300 BTU/SCF. As such, the first setpoint value can be equal to or greater than 300 BTU/SCF.

Controlling a flow of a supplemental fuel gas in supplemental fuel gas stream 50 can include, at block 311, calculating a second flow rate for the supplemental fuel gas that is required to change the net heating value in the combustion zone 15 to meet a second setpoint value, wherein the second setpoint value is equal to or greater than a second target net heating value for a combustion zone specified by regulation. As discussed herein, the second target value for NHV required by regulation in the combustion zone 15 is currently a minimum value of 270 BTU/SCF. As such, the second setpoint value can be equal to or greater than 270 BTU/SCF.

Controlling a flow of a supplemental fuel gas in supplemental fuel gas stream 50 can include determining which one of the net heating value of the vent gas in the vent gas stream and the net heating value for the combustion zone 15 requires more supplemental fuel gas to meet a setpoint net heating value. FIG. 3 shows the flare control system 200 uses decision block 312 to determine which net heating value parameter requires the larger flow of supplemental fuel gas and select the one that has the larger flow of supplemental fuel gas for the supplemental fuel gas control. At decision block 312, the larger flow of the supplemental fuel gas can be identified and/or selected as the selected flow rate for the supplemental fuel gas stream 50. Alternatively stated, block 312 can decide which calculated supplemental fuel gas flow rate is greater and identify/select the greater flow rate as the selected flow rate for the supplemental fuel gas stream 50.

Controlling a flow of a supplemental fuel gas in the supplemental fuel gas stream 50 can include adjusting the flow rate of the supplemental fuel gas in the supplemental fuel gas stream 50 (e.g., using the supplemental fuel gas valve 52) to the selected flow rate. Practically speaking, the flare control system 200 can actuate the supplemental fuel gas flow control valve 52 to the appropriate level to adjust the flow of the supplemental fuel gas to the selected flow rate.

Once one or more of the steam and the supplemental fuel gas is controlled, the vent gas of the vent gas stream 40 can be combusted in the flare 10 according to the flow rate controlled for steam and optionally according to the flow rate controlled for the supplemental fuel gas.

The control scheme used in the flare control system 400 is now described in detail using FIG. 4. Reference numerals for components in FIG. 2 can be referred to in this discussion for clarity.

The flare control system 400 can be configured to control, in real-time based at least in part on the concentration of the at least one hydrocarbon, a flow of air to the flare 10. Controlling a flow of air to the flare 10 can include one or more of:

at block 402, calculating a molecular weight of the vent gas in the vent gas stream 40 using the concentration of the at least one hydrocarbon obtained from the first gas analyzer 80 and the hydrogen scanning analyzer 82, and a molecular weight of the at least one hydrocarbon;

at block 404, measuring a velocity of the vent gas in the vent gas stream 40 using the vent gas flow meter 70;

at block 404, calculating the volumetric flow rate of the vent gas in the vent gas stream 40 using the measured vent gas velocity;

at block 404, calculating a total air:vent gas mole ratio for smokeless operation of the flare 10 using the concentration of the at least one hydrocarbon in the vent gas stream 40 multiplied by a standard air:hydrocarbon ratio required for smokeless operation of the flare 10 for the at least one hydrocarbon;

at block 404, calculating a required air flow rate for the flow of air to the flare 10 by multiplying the total air:vent gas mole ratio by the volumetric flow rate of the vent gas in the vent gas stream 40; and at block 406, adjusting the flow of air to the flare 10 to the required air flow rate. In an aspect, adjusting the flow of air to the flare 10 to the required air flow rate can include controlling a speed of one or more of the blowers 92*a* and 92*b* which is/are fluidly coupled with the flare 10.

In an aspect, adjusting a flow of air to the flare 10 to the required air flow rate includes comparing the sum of the air flowing to the flare 10 calculated at block 415 with air demand determined at block 406.

In aspects, controlling a flow of air to the flare 10 is not manually performed. In certain aspects, controlling a flow of air to the flare 10 does not require manual control at any time for any operating conditions of the flare as compared with a flare apparatus which does not control the flow of air in real-time and/or which does not measure the concentration with the first gas analyzer 80.

The flare control system 400 can be configured to control a flow of a supplemental fuel gas in the supplemental fuel gas stream 50 that combines with raw vent gas stream 31 to form the vent gas stream 40. Controlling a flow of a supplemental fuel gas in the supplemental fuel gas stream 50 by the flare control system 400 can include one or more of:

at block 408, calculating a net heating value of the vent gas in the vent gas stream 40 using the concentration of the at least one hydrocarbon and a net heating value for the at least one hydrocarbon;

at block 409, calculating a first flow rate for the supplemental fuel gas that is required to change the net heating value of the vent gas in the vent gas stream 40 to meet a first target value, wherein the first target value is optionally defined as a minimum net heating value for a vent gas specified by regulation;

at block 410, measuring a flow rate of the vent gas in the vent gas stream 40 using the vent gas flow meter 70;

at block 415, determining the current flow rate of air to the flare 10 using the signal of speed measurement from blowers 92*a* and 92*b* via communication lines 95*a* and 95*b;* at block 410, calculating a net heating value dilution parameter in a combustion zone 15 in the flare 10 using the flow rate of the vent gas in the vent gas stream 40, the flow rate of air to the flare 10, the net heating value calculated for the vent gas, and a diameter of a flare tip 13 of the flare 10;

at block 411, calculating a second flow rate for the supplemental fuel gas that is required to change the net heating value dilution parameter of the combustion zone 15 to meet a second target value, wherein the second target value is optionally defined as a minimum net heating value dilution parameter for a combustion zone specified by regulation;

at decision block 412, determining and selecting which one of the net heating value of the vent gas in the vent gas stream 40 and the net heating value dilution parameter for the combustion zone 15 is a selected net heating value that requires more supplemental fuel gas to meet the respective setpoint value (or alternatively stated, determining which one of the first flow rate and the second flow rate is greater, and identifying the greater one as a selected flow rate);

at block 414, adjusting the flow of the supplemental fuel gas in the supplemental fuel gas stream 50 to the selected flow rate.

Algorithms and programming of the flare control system 400 in FIG. 4 are designated inside the dashed lines. The equipment of the flare apparatus, e.g., the vent gas flow meter 70, the first gas analyzer 80, the hydrogen scanning analyzer 82, the optional second gas analyzer 84, the supplemental fuel gas flow control valve 52, and the blowers 92*a* and 92*b* are shown as networked with the flare control system 400.

A description of each variable and the associated units used in the equations to explain the functionality of the flare control system 400 are listed below:

$AIR:VG_{Total}$ Required ratio of air flow to total vent gas flow to maintain flame smokeless operation, SCF/SCF $AIR:VG_{comp\ n}$ Required ratio of air to pure component 'n' to maintain smokeless operation, SCF/SCF D Pipe diameter, FT $D_{tip}$ Diameter of the flare tip, FT $MOL\ \%_{COMP\ n}$ Mole percent of component 'n' in the vent gas stream $MW_{vg}$ Calculated molecular weight of the vent gas based on stream composition, LB/LB-MOL $NHV_{dil}$ Net heating value dilution parameter, BTU/FT$^2$ $NHV_{dil\ setpoint}$ Net heating value dilution parameter setpoint greater than or equal to 22 BTU/FT$^2$ $NHV_{sg}$ Net heating value of the sweetening gas, BTU/SCF $NHV_{vg}$ Net heating value of the vent gas stream, BTU/SCF $NHV_{vg\ setpoint}$ Vent gas net heating value setpoint, BTU/SCF $NHV_{COMP\ n}$ Net heating value of component 'n' in the vent gas stream BTU/SCF $P_A$ Actual pressure, PSIA $P_S$ Standard pressure, 14.696 PSIA $Q_{air/req}$ Flowrate of air, SCF/MIN $Q_{sg,VOL}$ Flowrate of sweetening gas, MSCF/HR $Q_{sg,VOL}$ Flowrate of vent gas, MSCF/HR $Q_{vg,VOL}$ RSP Remote setpoint for controller $T_A$ Actual temperature, ° F.

$Ts_S$ Standard temperature, 68° F.

$V_{vg}$ Vent gas velocity in the main flare header, FT/SEC

Controlling a flow of air to the flare 10 can include calculating a molecular weight of the vent gas in the vent gas stream 40 using the concentration of the at least one hydrocarbon and a molecular weight of the at least one hydrocarbon. Recall the concentration of at least one hydrocarbon and other gas components of the vent gas in the vent gas stream 40 are measured by the first gas analyzer 80 in units of mol %. The flare control system 400 can use the following equation to make the calculation for the total molecular weight of the vent gas in the vent gas stream 40:

$$MW_{vg} = \frac{\sum (mol\%_{compn}) * (MW_{compn})}{NF}.$$

s Note that the above equation sums the multiple of the numerator value for the respective number "n" of components. The normalization factor, NF, is provided by the first gas analyzer 80 and is in units of mol %. In the absence of any needed normalization recommended by the first gas analyzer 80, a value of 1 is used for the normalization factor. Component molecular weights can be found in literature, and Table 2 below gives some example molecular weight values in units of LB/LB-MOL:

TABLE 2

| Component | Molecular Weight (LB/LBMOL) | Air Ratio (SCF Air/ SCF component) | Target NHV (BTU/SCF) |
|---|---|---|---|
| Nitrogen | 28.01 | 0 | 0 |
| Water | 18.02 | 0 | 0 |
| Hydrogen | 2.02 | 0 | 274 (1212) |
| Methane | 16.04 | 0 | 896 |
| Ethane | 30.07 | 1.67-5.00 | 1595 |
| Propane | 44.10 | 2.38-7.14 | 2281 |
| n-Butane | 58.12 | 3.10-9.29 | 2968 |
| Isobutane | 58.12 | 3.10-9.29 | 2957 |
| C5's | 72.15 | 4.44-13.33 | 3655 |
| Ethylene | 28.05 | 4.29-5.71 | 1477 |
| Propylene | 42.08 | 6.43-8.57 | 2150 |
| Methyl Acetylene | 40.06 | 24.33-32.44 | 2088 |

TABLE 2-continued

| Component | Molecular Weight (LB/LBMOL) | Air Ratio (SCF Air/ SCF component) | Target NHV (BTU/SCF) |
|---|---|---|---|
| Propadiene | 40.06 | 7.30-9.73 | 2066 |
| Butenes | 56.11 | 8.57-11.43 | 2882 |
| Butadienes | 54.00 | 12.39-16.53 | 2690 |
| Acetylene | 26.04 | 16.24-21.65 | 1404 |
| Benzene | 78.11 | 10.71-14.29 | 3591 |
| Toluene | 92.14 | 12.86-17.14 | 4276 |
| C6+ | 84.16 | 12.86-17.14 | 3593 |

The molecular weights and target NHV values in Table 2 can be found in the Federal Register at 80 Fed. Reg. 75178, 75271 (Dec. 1, 2015), which is incorporated herein by reference in its entirety. The required air ratio for each component in Table 2 can be found, for example, in Pressure-relieving and Depressuring Systems, API Standard 521, 6$^{th}$ Ed. (Jan. 2014) at Section 5.7.3.2.5, which is incorporated herein by reference in its entirety. To the extent more than one value is given for the required air ratio, the higher value can be used as the initial setpoint. In aspects, a net heating value of 274 BTU/SCF for hydrogen is used for calculating $NHV_{vg}$, and a net heating value of 1212 BTU/SCF for hydrogen is used for calculating $NHV_{dil}$. Additional information can be found in Petroleum Refinery Sector Risk and Technology Review and New Source Performance Standards, 79 Fed. Reg. 36,880 (Jun. 30, 2014) and 40 CFR 63.11(b)(ii), each of which are incorporated herein by reference in their entirety.

Controlling a flow of air to the flare 10 can include measuring a velocity of the vent gas in the vent gas stream 40. An ultrasonic flow meter can be configured to utilize a single set of ultrasonic transducers to measure the vent gas velocity or to measure vent gas velocity with two sets of ultrasonic transducers. In a two-set transducer configuration, the ultrasonic flow meter can further be configured to use both sets of transducers to generate an average velocity measurement with either a single range or a dual range (low-flow and high-flow) or to use a single set of transducers to measure a low-flow regime and the other set of transducers to measure a high-flow regime using two sets of probes. Other velocity measurement technologies suitable for measuring vent gas flow, such as the OSI OFS-2000F™ velocity measurement device using optical scintillation technology, may also be applied to provide the vent gas velocity measurement.

Controlling a flow of air to the flare 10 can include calculating the volumetric flow rate of the vent gas in the vent gas stream 40 using the calculated velocity. The flare control system 400 can use one of the following equations to make the calculation:

$$Q_{vg,VOL} = \left(V_{vg} * \pi\left(\frac{D}{2}\right)^2\right) * \left(\frac{(P_A) * (T_S + 459.69)}{(P_S) * (T_A + 459.69)}\right) * \frac{3600\ SEC/HR}{1000}$$

where $Q_{vg,VOL}$ is the volumetric flow rate of the vent gas in the vent gas stream 40 in units of MSCF per hour. The variable description and units for $V_{ag}$, D, $p_A$, $T_A$, $p_S$, and $T_s$ are given above. $p_A$ and $T_A$ can be measured by temperature sensor(s) 72 and pressure sensor(s) 74 placed in the vent gas stream 40 or otherwise measured by equipment in the vent gas stream 40 having capability of measuring the actual temperature and pressure of the vent gas in the vent gas stream 40.

Controlling a flow of air to the flare 10 can include calculating, at block 404, a total air:vent gas mole ratio for smokeless operation of the flare 10 using the concentration of the at least one hydrocarbon in the vent gas stream 40 multiplied by a standard air:hydrocarbon ratio required for smokeless operation of the flare 10 for the at least one hydrocarbon. The flare control system 400 can use the following equation to make the calculation in block 406:

$$\text{AIR:}VG_{Total} = \sum \frac{(\text{mol }\%_{comp\ n}) * (\text{AIR:}VG_{comp\ n})}{100 \text{ lb vent gas}}$$

The mol $\%_{COMP\ n}$ is the mole percent of a particular component n in the vent gas stream 40 obtained by the first gas analyzer 80. The standard air-to-vent gas ratio for a particular component n, AIR:$VG_{COMP\ n}$, is available in literature with examples shown in Table 2 above. Alternatively, the standard air-to-vent gas ratio for component n can be determined by empirical testing a given flare by adding a set of known flow rates of component n to the vent gas and adjusting the air flow to determine the required air flow to control smoke formation for each known flow rate of component n.

Controlling a flow of air to the flare 10 can include calculating a required air flow rate for the flow of air to the flare 10 by multiplying the total air:vent gas mole ratio by the volumetric flow rate of the vent gas in the vent gas stream 40. The flare control system 400 can use the following equation to make the calculation:

$$Q_{air,req} = (\text{AIR:}VG_{Total}) * .0167 \frac{HR}{\text{MIN}}$$

The variables used to calculate the required flow rate of air, $Q_{air,req}$, are explained above.

Controlling a flow of air to the flare 10 can include adjusting a flow of air to the flare 10 to the required air flow rate, $Q_{air,req}$. To do so, the speed of one or more of the blowers 92*a* and 92*b* is adjusted, if needed. The flare control system 400 can be programmed to associate a particular RPM of the variable drive motor in the blowers 92*a* and 92*b* with a particular volume of air. Alternatively, the flare control system 400 can be programmed to measure the air speed using an air flow meter coupled to each blower 92*a* and 92*b*, and to control the RPM of the variable drive motor so as to control the flow of the air to the flare 10. In aspects, adjusting a flow of air to the flare 10 to the required air flow rate includes controlling a speed of one or more of the blowers 92*a* and 92*b* which is/are fluidly coupled with the flare 10.

Controlling a flow of a supplemental fuel gas in the supplemental fuel gas stream 50 can include calculating a net heating value of the vent gas in the vent gas stream 40 using the concentration of the at least one hydrocarbon and a net heating value for the at least one hydrocarbon. The flare control system 400 can use the following equation to make the calculation in block 408:

$$NHV_{vg} = \frac{\Sigma(\text{mol }\%_{comp\ n}) * (NHV_{comp\ n})}{100}$$

where mol $\%_{comp\ n}$ is the concentration of component "n" in the vent gas stream 40 measured by the first gas analyzer 80 and $NHV_{comp\ n}$ is the net heating value of the component "n" which is available in the literature and examples for certain gasous components are provided in Table 2 above. Calculating a net heating value of the vent gas in the vent gas stream 40 can also utilize the concentration of hydrogen in the vent gas stream 40 measured by the hydrogen scanning analyzer 82. FIG. 4 shows that a value of 275 BTU/SCF should be used for the NHV of hydrogen when calculating the contribution of any measured hydrogen to the overall net heating value of the vent gas in the vent gas stream 40, $NHV_{vg}$.

Controlling a flow of a supplemental fuel gas in the supplemental fuel gas stream 50 can include measuring a flow rate of the vent gas in the vent gas stream 40 with the vent gas flow meter 70. The flow rate, referred to here for flare control system 400 interchangeably as $Q_{vg}$ or $Q_{vg,VOL}$, can be the volumetric flow rate, which is described using the equation for $Q_{vg,VOL}$ above. To obtain the $Q_{vg,VOL}$, $V_{vg}$ (the velocity of the vent gas in the vent gas stream 40) is obtained. The value of $V_{vg}$ (the velocity of the vent gas in the vent gas stream 40) obtained by the flare control system 400 can be the velocity measurement made by the vent gas flow meter 70.

Controlling a flow of a supplemental fuel gas in the supplemental fuel gas stream 50 can include determining a flow rate of air to the flare 10. The air flow rate, referred to here as $Q_{air,VOL}$, can be determined by the flare control system 400 by determining the speed of the variable frequency drive motors of the blowers 92*a* and 92*b* and matching the speed(s) with the corresponding air flow rates from blower curves stored on or accessible by the flare control system 400.

Controlling a flow of a supplemental fuel gas in the supplemental fuel gas stream 50 can include calculating a net heating value dilution parameter in the combustion zone 15 in the flare 10 using the flow rate of the vent gas in the vent gas stream 40, the net heating value calculated for the vent gas, the flow rate of air to the flare 10, and a diameter of a tip of the flare 10. The flare control system 400 can use the following equation to make the calculation in block 410:

$$NHV_{dil} = \frac{(Q_{vg} * NHV_{vg}) * D_{tip}}{(Q_{vg} + Q_{air,VOL})}.$$

The net heating value dilution parameter in the combustion zone 15, $NHV_{dil}$, uses the values for $NHV_{vg}$ and $Q_{vg}$ which are discussed above. This equation also includes the variable $Q_{air,VOL}$, which is determined as explained above when calculating the required air flow rate on a volumetric flow rate basis. The term $Q_{air,VOL}$, is used to account for the dilution effect of the air on the net heating value dilution parameter in the combustion zone 15, $NHV_{dil}$. FIG. 4 shows that a value of 1,212 BTU/SCF should be used for the NHV of hydrogen when calculating the contribution of any measured hydrogen to the overall net heating value dilution parameter in the combustion zone 15, $NHV_{dil}$. This equation also uses the value for $D_{tip}$ in units of ft, which is the diameter of the tip 13 of the flare 10. The effective tip diameter for a given flare is generally available from the manufacturer.

Controlling a flow of a supplemental fuel gas in supplemental fuel gas stream 50 can include, at block 409, calculating a first flow rate for the supplemental fuel gas that is required to change the net heating value of the vent gas in the vent gas stream 40 to meet a first setpoint value, wherein the first setpoint value is equal to or greater than a target net heating value for a vent gas specified by regulation. As discussed herein, the target value for NHV required by regulation for the vent gas in the vent gas stream 40 is currently a minimum value of 300 BTU/SCF. As such, the first setpoint value can be equal to or greater than 300 BTU/SCF.

Controlling a flow of a supplemental fuel gas in supplemental fuel gas stream 50 can include, at block 411, calculating a second flow rate for the supplemental fuel gas that is required to change the net heating value dilution parameter in the combustion zone 15 to meet a second setpoint value, wherein the second setpoint value is equal to or greater than a target net heating value dilution parameter for a combustion zone specified by regulation. As discussed herein, the target value for NHV dilution parameter required by regulation in the combustion zone 15 is currently a minimum value of 22 BTU/SQF. As such, the second setpoint value can be equal to or greater than 22 BTU/SQF.

Controlling a flow of a supplemental fuel gas in the supplemental fuel gas stream 50 can include determining which one of the net heating value of the vent gas in the vent gas stream 40 and the net heating value dilution parameter in the combustion zone 15 requires more supplemental fuel gas to meet its setpoint value. FIG. 4 shows the flare control system 400 uses decision block 412 to determine which of the net heating value and the net heating value dilution parameter requires the larger supplemental fuel gas flow and to select the one that requires the larger supplemental fuel gas flow. At decision block 412, the larger flow of the supplemental fuel gas can be identified and/or selected as the selected flow rate for the supplemental fuel gas stream 50. Alternatively stated, block 412 can decide which calculated supplemental fuel gas flow rate is greater and identify/select the greater flow rate as the selected flow rate for the supplemental fuel gas stream 50.

Controlling a flow of a supplemental fuel gas in the supplemental fuel gas stream 50 can include adjusting the flow rate of the supplemental fuel gas stream 50 (e.g., using the supplemental fuel gas valve 52) to the selected flow rate. Practically speaking, the flare control system 400 can actuate the supplemental fuel gas flow control valve 52 to the appropriate level to adjust the flow of the supplemental fuel gas to the selected flow rate.

Once one or more of the air and supplemental fuel gas is controlled, the vent gas of the vent gas stream 40 can be combusted in the flare 10 according to the flow rate controlled for air and optionally according to the flow rate controlled for the supplemental fuel gas.

FIG. 5 illustrates a detailed view of another flare control system 500 that can be utilized in the apparatus 100 of FIG. 1. In the flare control system 500 in FIG. 5, the flow of steam is controlled in the same manner as described for the flare control system 200 in FIG. 3; thus, the description of steam flow control is not reproduced here. The flow of supplement fuel gas is controlled by accounting for and reconciling any differences in the concentration of species in the vent gas measured by i) the first gas analyzer 80 and optionally the hydrogen scanning analyzer 82, and ii) the second gas analyzer 84.

The same calculations for $NHV_{vg}$ and $NHV_{cz}$ as described for FIG. 3 can be performed by the flare control system 500 for the concentrations measured by the first gas analyzer 80 and hydrogen scanning analyzer 82. Additionally for the flare control system 500, these values can be identified as the $NHV_{vg}$ and $NHV_{cz}$ values calculated for the first gas analyzer 80 and hydrogen scanning analyzer 82, associated with the time (t) at which the sample of vent gas was collected, and stored in a datastore of the flare control system 500. The values for vent gas flow and steam flow rate at time (t) can also be stored in the datastore of the flare control system 500 for later calculation of the $NHV_{vg}$ and $NHV_{cz}$ values at time (t) using concentrations obtained with the second gas analyzer 84. The flare control system 500 can be configured to separately calculate $NHV_{vg}$ and $NHV_{cz}$ values for the concentrations measured by the second gas analyzer 84. The value for $NHV_{vg}$ can be calculated in the same manner as described for FIG. 3 using concentrations measured by the second gas analyzer 84 at block 508 in FIG. 5, and the value for $NHV_{cz}$ can be calculated in the same manner described for FIG. 3 using the concentrations measured by the second gas analyzer 84 at block 510 in FIG. 5, as well as the vent gas flow rate and steam flow rate stored in datastore for time (t).

At block 509 of the flare control system 500 of FIG. 5, the value for $NHV_{vg}$ obtained in block 308 at a particular time (t) using the concentrations measured by the first gas analyzer 80 and hydrogen scanning analyzer 82 ($NHV_{vg\ 1}$) is reconciled with the value for $NHV_{vg}$ obtained in block 508 at the particular time (t) using the concentrations measured by the second gas analyzer 84 ($NHV_{vg\ 2}$). To reconcile any difference between $NHV_{vg\ 1}$ and $NHV_{vg\ 2}$, the flare control system 500 is configured to take the ratio of $NHV_{vg\ 2}$ to $NHV_{vg\ 1}$ and multiply said ratio by the value for $NHV_{vg\ 1}$ obtained in block 308, according to the following equation:

$$NHV_{vg\ reconciled} = \frac{NHV_{vg\ 2}}{NHV_{vg\ 1}} \times NHV_{vg\ 1}$$

The value for $NHV_{vg\ reconciled}$ is the value that is used to calculate the flow rate of supplemental fuel gas in block 309 of FIG. 5, which is performed in the same manner as described for block 309 of FIG. 3, except that $NHV_{vg\ reconciled}$ according to the above equation is used instead of the raw $NHV_{vg}$ value obtained using measurements only from the first gas analyzer 80 and the hydrogen scanning analyzer 82.

At block 511 of the flare control system 500 of FIG. 5, the value for $NHV_{cz}$ obtained in block 310 at a particular time (t) using the concentrations measured by the first gas analyzer 80 and hydrogen scanning analyzer 82 ($NHV_{cz\ 1}$) is reconciled with the value for $NHV_{cz}$ obtained in block 510 at the particular time (t) using the concentrations measured by the second gas analyzer 84 ($NHV_{cz\ 2}$). To reconcile any difference between $NHV_{cz\ 1}$ and $NHV_{cz\ 2}$, the flare control system 500 is configured to take the ratio of $NHV_{cz\ 2}$ to $NHV_{cz\ 1}$ and multiply said ratio by the value for $NHV_{cz\ 1}$ obtained in block 310, according to the following equation:

$$NHV_{cz\ reconciled} = \frac{NHV_{cz\ 2}}{NHV_{cz\ 1}} \times NHV_{cz\ 1}$$

The value for $NHV_{cz\ reconciled}$ is the value that is used to calculate the flow rate of supplemental fuel gas in block 311 of FIG. 5, which is performed in the same manner as described for block 311 of FIG. 3, except that $NHV_{cz\ reconciled}$ according to the above equation is used instead of the raw $NHV_{cz}$ value obtained using measurements only from the first gas analyzer 80 and the hydrogen scanning analyzer 82.

Alternatively, at block 511, the $NHV_{cz\ reconciled}$ value can be obtained by using $H_2$-adjusted NHVs in the ratio. The following equation describes the use of such ratio:

$$NHV_{cz\ reconciled} = \frac{NHV_{H2\ adjusted\ 2}}{NHV_{H2\ adjusted\ 1}} \times NHV_{cz\ 1}$$

The "$NHV_{H2\ adjusted\ 1}$" value is the hydrogen-adjusted net heating value calculated using one or more of the concentrations measured by the first gas analyzer 80 and hydrogen scanning analyzer 82 at time (t). The "$NHV_{H2\ adjusted\ 2}$" value is the hydrogen-adjusted net heating value calculated using one or more of the concentrations measured by the second gas analyzer 84 at time (t). The $NHV_{cz\ 1}$ value is obtained in block 310 at a particular time (t) using the concentrations measured by the first gas analyzer 80 and hydrogen scanning analyzer 82. The value for $NHV_{cz\ reconciled}$ is the value that is used to calculate the flow rate of supplemental fuel gas in block 311 of FIG. 5, which is performed in the same manner as described for block 311 of FIG. 3, except that $NHV_{cz\ reconciled}$ according to the above equation is used instead of the raw $NHV_{cz}$ value obtained using measurements only from the first gas analyzer 80 and the hydrogen scanning analyzer 82.

In the flare control system 500, blocks 312 and 314 are still used as described for FIG. 3 in order to control the flow rate of the supplemental fuel gas in the supplemental fuel gas stream 50.

In aspects, the flare control system 500 can be configured to periodically update the values for the ratio of $NHV_{vg\ 2}$ to $NHV_{vg\ 1}$ that are used to calculated the value for $NHV_{vg\ reconciled}$ at time t=0 to time t=X. In an aspect where the second gas analyzer 84 is slower to report concentrations in the vent gas than the first gas analyzer 80, time t=0 is the time when the second gas analyzer 84 reports concentrations by which $NHV_{vg}$ values can be calculated, and time t=X is the time when the second gas analyzer 84 updates a new value for the $NHV_{vg}$ in the vent gas. In such a scenario, the first gas analyzer 80 can report values of concentration in the vent gas more frequently. An equation to describe this updating technique is shown below:

$$NHV_{vg\ reconciled\ t=0\ to\ X} = \frac{NHV_{vg\ 2\ t=0}}{NHV_{vg\ 1\ t=0}} \times NHV_{vg\ 1\ t=0\ to\ X}$$

It can be seen that the ratio is based on the values for $NHV_{vg\ 2}$ to $NHV_{vg\ 1}$ at time t=0. These values can be used until time X, e.g., the time when the second gas analyzer 84 reports another set of concentrations of components in the vent gas. For the period of time period from t=0 to t=X, the ratio value stays the same since the $NHV_{vg}$ values are those used at time t=0, while the value for $NHV_{vg\ t=o\ to\ x}$ updates as new values become available from concentration measurements made by the first gas analyzer 80 until time X. At time X, the ratio can be updated based on the values for $NHV_{vg\ 2}$ to $NHV_{vg\ 1}$ at time t=X. These values can be used to calculate the ratio until time Y, e.g., the time when the second gas analyzer 84 reports another set of concentrations of components in the vent gas. For the period of time period from t=X to t=Y, the ratio value stays the same since the $NHV_{vg}$ values are those used at time t=X, while the value for $NHV_{vg\ t=x\ to\ y}$ updates as new values become available from concentration measurements made by the first gas analyzer 80 until time Y.

In aspects, the flare control system 500 can be configured to periodically update the values for the ratio of $NHV_{cz\ 2}$ to $NHV_{cz\ 1}$ that are used to calculated the value for $NHV_{cz\ reconciled}$ at time t=0 to time t=X. In an aspect where the second gas analyzer 84 is slower to report concentrations in the vent gas than the first gas analyzer 80, time t=0 is the time when the second gas analyzer 84 reports concentrations by which $NHV_{cz}$ values can be calculated, and time t=X is the time when the second gas analyzer 84 updates a new value for the $NHV_{cz}$ in the combustion zone 15. In such a scenario, the first gas analyzer 80 can report values of concentration in the vent gas more frequently. An equation to describe this updating technique is shown below:

$$NHV_{cz\ reconciled\ t=0\ to\ X} = \frac{NHV_{cz\ 2\ t=0}}{NHV_{cz\ 1\ t=0}} \times NHV_{cz\ 1\ t=0\ to\ X}$$

It can be seen that the ratio is based on the values for $NHV_{cz\ 2}$ to $NHV_{cz\ 1}$ at time t=0. These values can be used until time X, e.g., the time when the second gas analyzer 84 reports another set of concentrations of components in the vent gas. For the period of time period from t=0 to t=X, the ratio value stays the same since the $NHV_{cz}$ values are those used at time t=0, while the value for $NHV_{cz\ t=0\ to\ x}$ updates as new values become available from concentration measurements made by the first gas analyzer 80 until time X. At time X, the ratio can be updated based on the values for $NHV_{cz\ 2}$ to $NHV_{cz\ 1}$ at time t=X. These values can be used to calculate the ratio until time Y, e.g., the time when the second gas analyzer 84 reports another set of concentrations of components in the vent gas. For the period of time period from t=X to t=Y, the ratio value stays the same since the $NHV_{cz}$ values are those used at time t=X, while the value for $NHV_{cz\ t=x\ to\ y}$ updates as new values become available from concentration measurements made by the first gas analyzer 80 until time Y.

Recall that as discussed for FIG. 1 and FIG. 2, gas analyzers 80, 82, and 84 can analyze samples of the vent gas via sample streams 41/42/43/44. In aspects, the flare control system 500 can be configured to compensate for lead or lag time between i) when the first gas analyzer 80 analyzes a portion of a sample of vent gas and ii) when the second gas analyzer 84 analyzes another portion of the sample of vent gas. For example, it is contemplated that the first gas analyzer 80 can be installed into an existing flare 10 that already has a second gas analyzer 84 installed (e.g., configured as a gas chromatograph). Due to the space available at the flare 10, the first gas analyzer 80 and the hydrogen scanning analyzer 82 can be located at a distance from the second gas analyzer 84, even in a separate enclosure, and thus, a lead time exists which amounts to the difference in time from the time at which a portion of the sample is analyzed in the first gas analyzer 80 and the time at which another portion of the sample is analyzed in the second gas analyzer 84. Alternatively, there can be a lag time to transport a portion of the vent gas sample from the sample supply line of the second gas analyzer 84, through a connecting tubing (e.g., sample line 41), to the first gas analyzer 80 and the hydrogen scanning analyzer 82. In such a scenario, a lag time exists which amounts to the difference in time from the time at which a portion of the sample is analyzed in the second gas analyzer 84 and the time at which another portion of the sample is analyzed in the first gas analyzer 80. By example only, for a sample line flow of 750 $cm^3$/min though 100 ft of a connecting line that is ¼ inch tubing, the lead or lag time can be as much as 40 seconds. Thus, in aspects, the lead or lag time between when a portion of a sample is analyzed by the first gas analyzer 80 and when another portion of a sample of the vent gas is analyzed by the second gas analyzer 84 is known.

The flare control system 500 can be configured to account for the lead or lag time between i) when the first gas analyzer 80 analyzes a portion of a sample of vent gas and ii) when the second gas analyzer 84 analyzes another portion of the sample of vent gas. In aspects, the second gas analyzer 84 can be configured to communicate (e.g., via appropriate networking as described herein) to the flare control system 500 when a portion of the sample is measured, in order to start the lead/lag time window. Recall that the flare control system 500 can be configured to use a first setpoint value for the $NHV_{vg}$ which is equal to greater than the minimum $NHV_{vg}$ required by regulation and to use a second setpoint value for the $NHV_{cz}$ which is equal to greater than the minimum $NHV_{cz}$ required by regulation, in order to determine, select, and control the flow rate of supplemental fuel gas in the supplemental fuel gas stream 50. In aspects having lead or lag time considerations, the flare control system 500 can be configured to make several additional determinations at block 509 and block 511.

At block 509, the flare control system 500 can be additionally configured to determine if the net heating value of the vent gas is less than the first target value. As discussed for FIG. 3, the first target value can be a minimum net heating value for a vent gas specified by regulation. If the net heating value of the vent gas is less than the first target value, the flare control system 500 can be configured to adjust the first setpoint value to a higher vent gas setpoint value that is greater than the first setpoint value. In an aspect, the flare control system 500 can maintain the higher vent gas setpoint value in place of the first setpoint value for a period of time, for example, the time it takes for the second gas analyzer to complete 1, 2, 3, 4, or 5 analyses.

At block 309, when the flare control system 500 maintains the higher vent gas setpoint value in place of the first setpoint value, the flow rate required for the supplemental flow gas that is calculated in block 309 can utilize the higher vent gas setpoint value instead of the first setpoint value.

At block 511, the flare control system 500 can be additionally configured to determine if the net heating value in the combustion zone is less than the second target value. As discussed for FIG. 3, the second target value can be a minimum net heating value in the combustion zone 15 specified by regulation. If the net heating value in the combustion zone 15 is less than the second target value, the flare control system 500 can be configured to adjust the second setpoint value to a higher combustion zone setpoint value that is greater than the second setpoint value. In an aspect, the flare control system 500 can maintain the higher combustion zone setpoint value in place of the second setpoint value for a period of time, for example, the time it takes for the second gas analyzer to complete 1, 2, 3, 4, or 5 analyses.

At block 311, when the flare control system 500 can maintain the higher combustion zone setpoint value in place of the second setpoint value, the flow rate required for the supplemental flow gas that is calculated in block 311 can utilize the higher combustion zone setpoint value instead of the second setpoint value.

Figure 6:
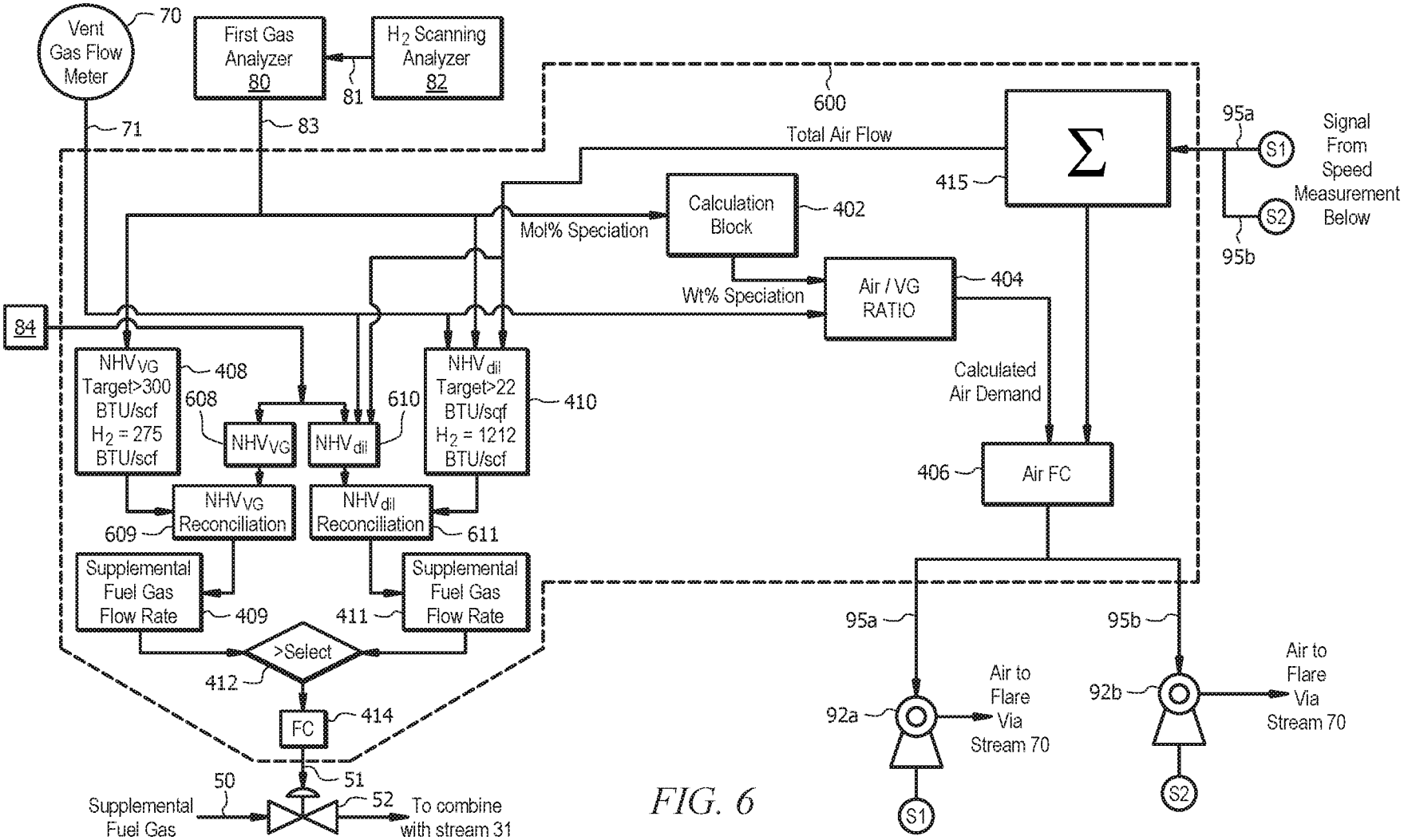
FIG. 6 illustrates a detailed view of another flare control system that can be utilized in the apparatus of FIG. 2.

FIG. 6 illustrates a detailed view of another flare control system 600 that can be utilized in the apparatus 200 of FIG. 2. In the flare control system 600 in FIG. 6, the flow of air is controlled in the same manner as described for the flare control system 400 in FIG. 4; thus, the description of steam flow control is not reproduced here. The flow of supplement fuel gas is controlled by accounting for and reconciling any differences in the concentration of species in the vent gas measured by i) the first gas analyzer 80 and optionally the hydrogen scanning analyzer 82, and ii) the second gas analyzer 84.

The same calculations for $NHV_{vg}$ and $NHV_{dil}$ as described for FIG. 4 can be performed by the flare control system 600 for the concentrations measured by the first gas analyzer 80 and hydrogen scanning analyzer 82. Additionally for the flare control system 600, these values can be identified as the $NHV_{vg}$ and $NHV_{dil}$ values calculated for the first gas analyzer 80 and hydrogen scanning analyzer 82, associated with the time (t) at which the sample of vent gas was collected, and stored in a datastore of the flare control system 600. The values for vent gas flow and air flow rate at time (t) can also be stored in the datastore of the flare control system 600 for later calculation of the $NHV_{vg}$ and $NHV_{dil}$ values at time (t) using concentrations obtained with the second gas analyzer 84. The flare control system 600 is configured to separately calculate $NHV_{vg}$ and $NHV_{dil}$ values for the concentrations measured by the second gas analyzer 84. The value for $NHV_{vg}$ is calculated in the same manner as described for FIG. 4 using concentrations measured by the second gas analyzer 84 at block 608 in FIG. 6, and the value for $NHV_{dil}$ is calculated in the same manner as described for FIG. 4 using the concentrations measured by the second gas analyzer 84 at block 610 in FIG. 6, as well as the vent gas flow rate and air flow rate stored in datastore for time (t).

At block 609 of the flare control system 600 of FIG. 6, the value for $NHV_{vg}$ obtained in block 408 at a particular time (t) using the concentrations measured by the first gas analyzer 80 and hydrogen scanning analyzer 82 ($NHV_{vg\ 1}$) is reconciled with the value for $NHV_{vg}$ obtained in block 608 at the particular time (t) using the concentrations measured by the second gas analyzer 84 ($NHV_{vg\ 2}$). To reconcile any difference between $NHV_{vg\ 1}$ and $NHV_{vg\ 2}$, the flare control system 600 is configured to take the ratio of $NHV_{vg\ 2}$ to $NHV_{vg\ 1}$ and multiply said ratio by the value for $NHV_{vg\ 1}$ obtained in block 408, according to the following equation:

$$NHV_{vg\ reconciled} = \frac{NHV_{vg\ 2}}{NHV_{vg\ 1}} \times NHV_{vg\ 1}$$

The value for $NHV_{vg\ reconciled}$ is the value that is used to calculate the flow rate of supplemental fuel gas in block 409 of FIG. 6, which is performed in the same manner as described for block 409 of FIG. 4, except that $NHV_{vg\ reconciled}$ according to the above equation is used instead of the raw $NHV_{vg}$ value obtained using measurements only from the first gas analyzer 80 and the hydrogen scanning analyzer 82.

At block 611 of the flare control system 600 of FIG. 6, the value for $NHV_{dil}$ obtained in block 410 at a particular time (t) using the concentrations measured by the first gas analyzer 80 and hydrogen scanning analyzer 82 ($NHV_{dil\ 1}$) is reconciled with the value for $NHV_{dil}$ obtained in block 610 at the particular time (t) using the concentrations measured by the second gas analyzer 84 ($NHV_{dil\ 2}$). To reconcile any difference between $NHV_{dil\ 1}$ and $NHV_{dil\ 2}$, the flare control system 600 is configured to take the ratio of $NHV_{dil\ 2}$ to $NHV_{dil\ 1}$ and multiply said ratio by the value for $NHV_{dil\ 1}$ obtained in block 410, according to the following equation:

$$NHV_{dil\ reconciled} = \frac{NHV_{dil\ 2}}{NHV_{dil\ 1}} \times NHV_{dil\ 1}$$

The value for $NHV_{dil\ reconciled}$ is the value that is used to calculate the flow rate of supplemental fuel gas in block 411 of FIG. 6, which is performed in the same manner as described for block 411 of FIG. 4, except that $NHV_{dil\ reconciled}$ according to the above equation is used instead of the raw $NHV_{dil}$ value obtained using measurements only from the first gas analyzer 80 and the hydrogen scanning analyzer 82.

Alternatively, at block 611, the $NHV_{dil\ reconciled}$ value can be obtained by using $H_2$-adjusted NHVs in the ratio. The following equation describes the use of such ratio:

$$NHV_{dil\ reconciled} = \frac{NHV_{H2\ adjusted\ 2}}{NHV_{H2\ adjusted\ 1}} \times NHV_{dil\ 1}$$

The "$NHV_{H2\ adjusted\ 1}$" value is the hydrogen-adjusted net heating value calculated using one or more of the concentrations measured by the first gas analyzer 80 and hydrogen scanning analyzer 82 at time (t). The "$NHV_{H2\ adjusted\ 2}$" value is the hydrogen-adjusted net heating value calculated using one or more of the concentrations measured by the second gas analyzer 84 at time (t). The $NHV_{dil\ 1}$ value is obtained in block 410 at a particular time (t) using the concentrations measured by the first gas analyzer 80 and hydrogen scanning analyzer 82. The value for $NHV_{dil\ reconciled}$ is the value that is used to calculate the flow rate of supplemental fuel gas in block 411 of FIG. 6, which is performed in the same manner as described for block 411 of FIG. 4, except that $NHV_{dil\ reconciled}$ according to the above equation is used instead of the raw $NHV_{dil}$ value obtained using measurements only from the first gas analyzer 80 and the hydrogen scanning analyzer 82.

In the flare control system 600, blocks 412 and 414 are still used as described for FIG. 4 in order to control the flow rate of the supplemental fuel gas in the supplemental fuel gas stream 50.

In aspects, the flare control system 600 can be configured to periodically update the values for the ratio of $NHV_{vg\ 2}$ to $NHV_{vg\ 1}$ that are used to calculated the value for $NHV_{vg\ reconciled}$ at time t=0 to time t=X. In an aspect where the second gas analyzer 84 is slower to report concentrations in the vent gas than the first gas analyzer 80, time t=0 is the time when the second gas analyzer 84 reports concentrations by which $NHV_{vg}$ values can be calculated, and time t=X is the time when the second gas analyzer 84 updates a new value for the $NHV_{vg}$ in the vent gas. In such a scenario, the first gas analyzer 80 can report values of concentration in the vent gas more frequently. An equation to describe this updating technique is shown below:

$$NHV_{vg\ reconciled\ t=0\ to\ X} = \frac{NHV_{vg\ 2\ t=0}}{NHV_{vg\ 1\ t=0}} \times NHV_{vg\ 1\ t=0\ to\ X}$$

It can be seen that the ratio is based on the values for $NHV_{vg\ 2}$ to $NHV_{vg\ 1}$ at time t=0. These values can be used until time X, e.g., the time when the second gas analyzer 84 reports another set of concentrations of components in the vent gas. For the period of time period from t=0 to t=X, the ratio value stays the same since the $NHV_{vg}$ values are those used at time t=0, while the value for $NHV_{vg\ t=0\ to\ x}$ updates as new values become available from concentration measurements made by the first gas analyzer 80 until time X. At time X, the ratio can be updated based on the values for $NHV_{vg\ 2}$ to $NHV_{vg\ 1}$ at time t=X. These values can be used to calculate the ratio until time Y, e.g., the time when the second gas analyzer 84 reports another set of concentrations of components in the vent gas. For the period of time period from t=X to t=Y, the ratio value stays the same since the $NHV_{vg}$ values are those used at time t=X, while the value for $NHV_{vg\ t=x\ to\ y}$ updates as new values become available from concentration measurements made by the first gas analyzer 80 until time Y.

In aspects, the flare control system 600 can be configured to periodically update the values for the ratio of $NHV_{dil\ 2}$ to $NHV_{dil\ 1}$ that are used to calculated the value for $NHV_{dil\ reconciled}$ at time t=0 to time t=X. In an aspect where the second gas analyzer 84 is slower to report concentrations in the vent gas than the first gas analyzer 80, time t=0 is the time when the second gas analyzer 84 reports concentrations by which $NHV_{dil}$ values can be calculated, and time t=X is the time when the second gas analyzer 84 updates a new value for the $NHV_{dil}$ in the combustion zone 15. In such a scenario, the first gas analyzer 80 can report values of concentration in the vent gas more frequently. An equation to describe this updating technique is shown below:

$$NHV_{dil\ reconciled\ t=0\ to\ X} = \frac{NHV_{dil\ 2\ t=0}}{NHV_{dil\ 1\ t=0}} \times NHV_{dil\ 1\ t=0\ to\ X}$$

It can be seen that the ratio is based on the values for $NHV_{dil\ 2}$ to $NHV_{dil\ 1}$ at time t=0. These values can be used until time X, e.g., the time when the second gas analyzer 84 reports another set of concentrations of components in the vent gas. For the period of time period from t=0 to t=X, the ratio value stays the same since the $NHV_{dil}$ values are those used at time t=0, while the value for $NHV_{dil\ t=0\ to\ x}$ updates as new values become available from concentration measurements made by the first gas analyzer 80 until time X. At time X, the ratio can be updated based on the values for $NHV_{dil\ 2}$ to $NHV_{dil\ 1}$ at time t=X. These values can be used to calculate the ratio until time Y, e.g., the time when the second gas analyzer 84 reports another set of concentrations of components in the vent gas. For the period of time period from t=X to t=Y, the ratio value stays the same since the $NHV_{dil}$ values are those used at time t=X, while the value for $NHV_{dil\ t=x\ to\ y}$ updates as new values become available from concentration measurements made by the first gas analyzer 80 until time Y.

In aspects, the flare control system 600 can be configured to compensate for lead or lag time between i) when the first gas analyzer 80 analyzes a portion of a sample of vent gas and ii) when the second gas analyzer 84 analyzes another portion of the sample of vent gas. The lead and lag time are described for FIG. 5 and not reproduced here.

In aspects, the second gas analyzer 84 can be configured to communicate (e.g., via appropriate networking as described herein) to the flare control system 600 when a portion of the sample is measured. Recall that the flare control system 600 can be configured to use a first setpoint value for the $NHV_{vg}$ which is equal to greater than the minimum $NHV_{vg}$ required by regulation and to use a second setpoint value for the $NHV_{dil}$ which is equal to greater than the minimum $NHV_{dil}$ required by regulation, in order to determine, select, and control the flow rate of supplemental fuel gas in the supplemental fuel gas stream 50. In aspects having lead or lag time considerations, the flare control system 600 can be configured to make several additional determinations at block 609 and block 611.

At block 609, the flare control system 600 can be additionally configured to determine if the net heating value of the vent gas is less than the first target value. As discussed for FIG. 4, the first target value can be a minimum net heating value for a vent gas specified by regulation. If the net heating value of the vent gas is less than the first target value, the flare control system 600 can be configured to adjust the first setpoint value to a higher vent gas setpoint value that is greater than the first setpoint value. In an aspect, the flare control system 600 can maintain the higher vent gas setpoint value in place of the first setpoint value for a period of time, for example, the time it takes for the second gas analyzer to complete 1, 2, 3, 4, or 5 analyses.

At block 409, when the flare control system 600 maintains the higher vent gas setpoint value in place of the first setpoint value, the flow rate required for the supplemental flow gas that is calculated in block 409 can utilize the higher vent gas setpoint value instead of the first setpoint value.

At block 611, the flare control system 600 can be additionally configured to determine if the net heating value dilution parameter for the combustion zone 15 is less than the second target value. As discussed for FIG. 4, the second target value can be a minimum net heating value dilution parameter in the combustion zone 15 specified by regulation. If the net heating value dilution parameter calculated for the combustion zone 15 is less than the second target value, the flare control system 600 can be configured to adjust the second setpoint value to a higher combustion zone dilution parameter setpoint value that is greater than the second setpoint value. In an aspect, the flare control system 600 can maintain the higher combustion zone dilution parameter setpoint value in place of the second setpoint value for a period of time, for example, the time it takes for the second gas analyzer to complete 1, 2, 3, 4, or 5 analyses.

At block 411, when the flare control system 600 can maintain the higher combustion zone dilution parameter setpoint value in place of the second setpoint value, the flow rate required for the supplemental flow gas that is calculated in block 411 can utilize the higher combustion zone dilution parameter setpoint value instead of the second setpoint value.

Additional Description

Methods and flare apparatus for control of one or more of supplemental fuel gas, air, and steam to a flare have been described. The present application is also directed to the subject-matter described in the following numbered paragraphs (referred to as "para" or "paras":

Para 1. A method comprising:

measuring a concentration of at least one hydrocarbon of a vent gas in a vent gas stream upstream of a combustion zone of a flare;

feeding the vent gas in the vent gas stream to the flare; and controlling, in real-time based at least in part on the concentration of the at least one hydrocarbon, a flow of steam or air to the flare.

Para 2. The method of Para 1, wherein the flow of steam to the flare is controlled, wherein the step of controlling a flow of steam to the flare comprises:

calculating a molecular weight of the vent gas in the vent gas stream using the concentration of the at least one hydrocarbon and a molecular weight of the at least one hydrocarbon;

measuring a velocity of the vent gas in the vent gas stream;

calculating a mass flow rate of the vent gas in the vent gas stream using the measured vent as velocity, the molar volume at standard conditions of 385.3 SCF/LB-MOL, and the calculated molecular weight;

calculating a total steam:vent gas mass ratio for smokeless operation of the flare using the concentration of the at least one hydrocarbon in the vent gas stream multiplied by a standard steam:hydrocarbon ratio required for smokeless operation of the flare for the at least one hydrocarbon;

calculating a required steam flow rate for the flow of steam to the flare by multiplying the total steam:vent gas mass ratio by the total mass flow rate of the vent gas in the vent gas stream; and adjusting the flow of steam to the flare to the required steam flow rate.

Para 3. The method of Para 1 or 2, wherein the steam flows to the flare via a plurality of steam lines, wherein each of the plurality of steam lines is in parallel flow to the other of the plurality of steam lines, where each of the plurality of steam lines comprises a steam flow control valve and a steam flow meter.

Para 4. The method of Para 2 or 3, wherein the velocity of the vent gas in the vent gas stream is measured using an ultrasonic flow meter.

Para 5. The method of Para 1, wherein the flow of air to the flare is controlled, wherein the step of controlling a flow of air to the flare comprises:

calculating a molecular weight of the vent gas in the vent gas stream using the concentration of the at least one hydrocarbon and a molecular weight of the at least one hydrocarbon;

measuring a velocity of the vent gas in the vent gas stream;

calculating the volumetric flow rate of the vent gas in the vent gas stream using the calculated velocity;

calculating a total air:vent gas mole ratio for smokeless operation of the flare using the concentration of the at least one hydrocarbon in the vent gas stream multiplied by a standard air:hydrocarbon ratio required for smokeless operation of the flare for the at least one hydrocarbon;

calculating a required air flow rate for the flow of air to the flare by multiplying the total air:vent gas mole ratio by the volumetric flow rate of the vent gas in the vent gas stream; and adjusting a flow of air to the flare to the required air flow rate.

Para 6. The method of Para 5, wherein the velocity of the vent gas in the vent gas stream is measured using an ultrasonic flow meter.

Para 7. The method of Para 5 or 6, wherein adjusting a flow of air to the flare to the required air flow rate comprises controlling a speed of one or more blowers fluidly coupled with the flare.

Para 8. The method of any of Paras 1 to 7, further comprising:

controlling, in real-time based at least in part on the concentration of the at least one hydrocarbon, a flow of natural gas or fuel gas into the vent gas stream, Para 9. The method of Para 8, wherein controlling a flow of natural gas or fuel gas is not manually performed.

Para 10. The method of Para 8 or 9, wherein controlling a flow of natural gas or fuel gas does not require manual control at any time over the entire set of operating conditions of the flare as compared with a method not utilizing a real-time gas analyzer such as the online tunable infrared absorption based gas analyzer described herein.

Para 11. The method of any of Paras 8-10, wherein controlling a flow of natural gas or fuel gas comprises:

calculating a net heating value of the vent gas in the vent gas stream using the concentration of the at least one hydrocarbon and a net heating value for the at least one hydrocarbon;

calculating a first flow rate for the natural gas or fuel gas that is required to change the net heating value of the vent gas in the vent gas stream to meet a first setpoint value, wherein the first setpoint value is optionally defined as equal to or greater than a minimum net heating value for a vent gas specified by regulation;

calculating a net heating value in a combustion zone of the flare using the flow rate of the vent gas in the vent gas stream, a flow rate of steam to the flare, and the net heating value for the vent gas;

calculating a second flow rate for the natural gas or fuel gas that is required to change the net heating value in the combustion zone to meet a second setpoint value, wherein the second setpoint value is optionally defined as equal to or greater than a minimum net heating value for a combustion zone specified by regulation;

determining and selecting which one of the net heating value of the vent gas in the vent gas stream and the net heating value in the combustion zone is a selected net heating value that requires more natural gas or fuel gas to meet the respective setpoint value (or alternatively stated, determining which one of the first flow rate and the second flow rate is greater, and identifying the greater one as the selected flow rate);

adjusting a flow of the natural gas or fuel gas to the selected flow rate.

Para 12. The method of any of Paras 8-10, wherein controlling a flow of natural gas or fuel gas comprises:

calculating a net heating value of the vent gas in the vent gas stream using the concentration of the at least one hydrocarbon and a net heating value for the at least one hydrocarbon;

calculating a first flow rate for the natural gas or fuel gas that is required to change the net heating value of the vent gas in the vent gas stream to meet a first setpoint value, wherein the first setpoint value is optionally defined as equal to or greater than a minimum net heating value for a vent gas specified by regulation;

calculating a net heating value dilution parameter in a combustion zone of the flare using the flow rate of the vent gas in the vent gas stream, the flow rate of air to the flare, the net heating value for the vent gas, and a diameter of a tip of the flare;

calculating a second flow rate for the natural gas or fuel gas that is required to change the net heating value dilution parameter of the combustion zone to meet a second setpoint value, wherein the second setpoint value is optionally defined as equal to or greater than a minimum net heating value dilution parameter for a combustion zone specified by regulation;

determining and selecting which one of the net heating value of the vent gas in the vent gas stream and the net heating value dilution parameter for the combustion zone is a selected net heating value that requires more natural gas or fuel gas to meet the respective setpoint value (or alternatively stated, determining which one of the first flow rate and the second flow rate is greater, and identifying the greater one as a selected flow rate); and adjusting the flow of the natural gas or fuel gas to the selected flow rate.

Para 13. The method of any of Paras 8-10, wherein controlling a flow of natural gas or fuel gas comprises:

calculating a first net heating value of the vent gas in the vent gas stream using the concentration of the at least one hydrocarbon that is received from a first gas analyzer and a net heating value for the at least one hydrocarbon;

calculating a second net heating value of the vent gas in the vent gas stream using the concentration of the at least one hydrocarbon that is received from a second gas analyzer and a net heating value for the at least one hydrocarbon;

multiplying the first net heating value of the vent gas by a ratio of the second net heating value of the vent gas to the first net heating value of the vent gas to obtain a reconciled net heating value of the vent gas;

calculating a first flow rate for the natural gas or fuel gas that is required to change the reconciled net heating value of the vent gas in the vent gas stream to meet a first setpoint value, wherein the first setpoint value is optionally defined as equal to or greater than a minimum net heating value for a vent gas specified by regulation;

calculating a first net heating value dilution parameter in a combustion zone of the flare using the flow rate of the vent gas in the vent gas stream, a flow rate of steam to the flare, and the first net heating value for the vent gas calculated using the concentration of the at least one hydrocarbon that is received from the first gas analyzer;

calculating a second net heating value in the combustion zone of the flare using the flow rate of the vent gas in the vent gas stream, a flow rate of steam to the flare, and the second net heating value for the vent gas calculated using the concentration of the at least one hydrocarbon that is received from the second gas analyzer;

multiplying the first net heating value dilution parameter by a ratio of the second net heating value dilution parameter to the first net heating value dilution parameter to obtain a reconciled net heating value dilution parameter in the combustion zone;

calculating a second flow rate for the natural gas or fuel gas that is required to change the reconciled net heating value dilution parameter in the combustion zone to meet a second setpoint value, wherein the second setpoint value is optionally defined as equal to or greater than a minimum net heating value dilution parameter for a combustion zone specified by regulation;

determining and selecting which one of the reconciled net heating value of the vent gas in the vent gas stream and the reconciled net heating value dilution parameter in the combustion zone is a selected net heating value that requires more natural gas or fuel gas to meet the respective setpoint value (or alternatively stated, determining which one of the first flow rate and the second flow rate is greater, and identifying the greater one as the selected flow rate); and adjusting a flow of the natural gas or fuel gas to the selected flow rate.

Para 14. The method of any of Paras 8-10, wherein controlling a flow of natural gas or fuel gas comprises:

calculating a first net heating value of the vent gas in the vent gas stream using the concentration of the at least one hydrocarbon that is received from a first gas analyzer and a net heating value for the at least one hydrocarbon;

calculating a second net heating value of the vent gas in the vent gas stream using the concentration of the at least one hydrocarbon that is received from a second gas analyzer and a net heating value for the at least one hydrocarbon;

multiplying the first net heating value of the vent gas by a ratio of the second net heating value of the vent gas to the first net heating value of the vent gas to obtain a reconciled net heating value of the vent gas;

calculating a first flow rate for the natural gas or fuel gas that is required to change the reconciled net heating value of the vent gas in the vent gas stream to meet a first setpoint value, wherein the first setpoint value is optionally defined as equal to or greater than a minimum net heating value for a vent gas specified by regulation;

calculating a first net heating value dilution parameter in a combustion zone of the flare using the flow rate of the vent gas in the vent gas stream, a flow rate of air to the flare, and the first net heating value for the vent gas calculated using the concentration of the at least one hydrocarbon that is received from the first gas analyzer;

calculating a second net heating value dilution parameter in the combustion zone of the flare using the flow rate of the vent gas in the vent gas stream, a flow rate of air to the flare, a diameter of the flare tip, and the second net heating value for the vent gas calculated using the concentration of the at least one hydrocarbon that is received from the second gas analyzer;

multiplying the first net heating value dilution parameter by a ratio of the second net heating value dilution parameter to the first net heating value dilution parameter to obtain a reconciled net heating value dilution parameter in the combustion zone;

calculating a second flow rate for the natural gas or fuel gas that is required to change the reconciled net heating value dilution parameter in the combustion zone to meet a second setpoint value, wherein the second setpoint value is optionally defined as equal to or greater than a minimum net heating value dilution parameter for a combustion zone specified by regulation;

determining and selecting which one of the reconciled net heating value of the vent gas in the vent gas stream and the reconciled net heating value dilution parameter in the combustion zone is a selected net heating value that requires more natural gas or fuel gas to meet the respective setpoint value (or alternatively stated, determining which one of the first flow rate and the second flow rate is greater, and identifying the greater one as the selected flow rate); and adjusting a flow of the natural gas or fuel gas to the selected flow rate.

Para 15. The method of any of Paras 13-14, further comprising:

determining if the net heating value of the vent gas (calculated using information from the first gas analyzer and/or the second gas analyzer) is less than a first target value, wherein the first target value can be a minimum net heating value for a vent gas specified by regulation;

adjusting the first setpoint value to a higher vent gas setpoint value that is greater than the first setpoint value;

calculating a third flow rate for the natural gas or fuel gas that is required to change the net heating value of the vent gas in the vent gas stream to meet the higher vent gas setpoint value;

determining if the net heating value in the combustion zone is less than a second target value, wherein the second target value can be a minimum net heating value in the combustion zone specified by regulation;

adjusting the second setpoint value to a higher combustion zone setpoint value that is greater than the second setpoint value;

calculating a fourth flow rate for the natural gas or fuel gas that is required to change the net heating value in the combustion zone to meet the higher combustion zone setpoint value;

determining which one of the third flow rate and the fourth flow rate is greater;

identifying the greater one as the selected flow rate; and adjusting the flow of the natural gas or fuel gas to the selected flow rate.

Para 16. The method of any of Paras 13-14, further comprising:

determining if the net heating value of the vent gas (calculated using information from the first gas analyzer and/or the second gas analyzer) is less than a first target value, wherein the first target value can be a minimum net heating value for a vent gas specified by regulation;

adjusting the first setpoint value to a higher vent gas setpoint value that is greater than the first setpoint value;

calculating a third flow rate for the natural gas or fuel gas that is required to change the net heating value of the vent gas in the vent gas stream to meet the higher vent gas setpoint value;

determining if the net heating value dilution parameter in the combustion zone is less than a second target value, wherein the second target value can be a minimum net heating value dilution parameter in the combustion zone specified by regulation;

adjusting the second setpoint value to a higher combustion zone setpoint value that is greater than the second setpoint value;

calculating a fourth flow rate for the natural gas or fuel gas that is required to change the net heating value dilution parameter in the combustion zone to meet the higher combustion zone setpoint value;

determining which one of the third flow rate and the fourth flow rate is greater;

identifying the greater one as the selected flow rate; and adjusting the flow of the natural gas or fuel gas to the selected flow rate.

Para 17. The method of any of Paras 1-16, wherein controlling a flow of steam or air to the flare is not manually performed.

Para 18. The method of any of Paras 1-17, wherein controlling a flow of steam or air to the flare does not require manual control at any time over the entire set of operating conditions of the flare as compared with a method which does control the flow in real-time and/or which does not measure concentration with the gas analyzer.

Para 19. The method of any of Paras 1-18, wherein the concentration of the at least one hydrocarbon is measured using an online tunable infrared absorption based gas analyzer that is the first gas analyzer of any of the paragraphs above.

Para 20. The method of any of Paras 1-19, wherein the concentration of the at least one hydrocarbon is additionally measured using gas chromatography that is the second gas analyzer of any of the paragraphs above.

Para 21. The method of any of Paras 1-20, further comprising:

measuring a hydrogen concentration in the vent gas stream;

controlling, in real-time based at least in part on the hydrogen concentration in the vent gas stream, the flow of steam or air to the flare.

Para 22. The method of any of Paras 1-21, wherein the step of measuring is performed by an online tunable infrared absorption based gas analyzer configured to analyze the vent gas in a sample stream taken from the vent gas stream or configured to analyze the vent gas in a flow path of the vent gas in the vent gas stream at a location between a knockout pot and the combustion zone of the flare.

Para 23. The method of Para 22, wherein the knockout pot is located in a cracking unit, a natural gas liquid facility, a polymer production facility, a poly alpha olefin (PAO) plant, a normal alpha olefin (NAO) plant, a reformer, a catalytic cracker, an alkylation process, any other petrochemical process, or refining process incorporating a flammable hydrocarbon, or a combination thereof.

Para 24. The method of any of Paras 1-23, wherein the at least one hydrocarbon of the vent gas in the vent gas stream has from 1-20 carbon atoms.

Para 25. The method of any of Paras 1-24, wherein the vent gas stream further comprises nitrogen, carbon monoxide, carbon dioxide, hydrogen, oxygen, water, fuel gas, natural gas, or a combination thereof.

Para 26. The method of any of Paras 1-25, further comprising:

combusting the at least one hydrocarbon in the presence of the flow of steam or air.

Para 27. A flare apparatus comprising:

a flare having a combustion zone;

a vent gas stream connected to the flare and configured to feed a vent gas to the flare upstream of the combustion zone;

an air stream or a steam stream configured to feed air or steam to the flare;

an online tunable infrared absorption based gas analyzer configured to analyze the vent gas in a sample stream taken from the vent gas stream or configured to analyze the vent gas in a flow path of the vent gas in the vent gas stream upstream of the combustion zone, wherein the gas analyzer is configured to measure a concentration of at least one hydrocarbon of the vent gas in the vent gas stream; and a flare control system coupled with the gas analyzer and configured to control, in real-time based at least in part on the concentration of the at least one hydrocarbon, a flow of steam or air to the flare.

Para 28. The flare apparatus of Para 27, further comprising:

a hydrogen scanning analyzer configured to measure a hydrogen concentration in the vent gas stream, wherein the flare control system is further configured to control, in real-time based at least in part on the hydrogen concentration in the vent gas stream, the flow of steam or air to the flare.

Para 29. The flare apparatus of Para 27 or 28, wherein the flare control system is further configured to control, in real-time based at least in part on the concentration of the at least one hydrocarbon, a flow of natural gas or fuel gas into the vent gas stream.

Para 30. The flare apparatus of any of Paras 27-29, wherein the gas analyzer is coupled with the vent gas stream at a location between a knockout pot and the combustion zone of the flare.

Para 31. The flare apparatus of Para 30, wherein the knockout pot is located in a cracking unit, a natural gas liquid facility, a polymer production facility, a poly alpha olefin (PAO) plant, a normal alpha olefin (NAO) plant, a reformer, a catalytic cracker, an alkylation process, any other petrochemical process, or refining process incorporating a flammable hydrocarbon, or a combination thereof.

Para 32. The flare apparatus of any of Paras 27-31, wherein the at least one hydrocarbon of the vent gas in the vent gas stream has from 1-20 carbon atoms.

Para 33. The flare apparatus of any of Paras 27-32, wherein the vent gas stream further comprises nitrogen, carbon monoxide, carbon dioxide, hydrogen, oxygen, water, fuel gas, natural gas, or a combination thereof.

Para 34. The flare apparatus of any of Paras 27-33, further comprising:

a gas chromatograph configured to measure the concentration of the at least one hydrocarbon by gas chromatography.

Para 35. The flare apparatus of any of Paras 27-34, further comprising:

an ultrasonic flow meter to measure a velocity of the vent gas in the vent gas stream.

Para 36. The flare apparatus of any of Paras 27-35, wherein the flare combusts the at least one hydrocarbon in the presence of the flow of steam or air.

At least one aspect and at least one embodiment are disclosed and variations, combinations, and/or modifications of the aspect(s) and embodiment(s) and/or features of the aspect(s) and embodiment(s) made by a person having ordinary skill in the art are within the scope of the disclosure. Alternative aspects and embodiments that result from combining, integrating, and/or omitting features of the aspect(s) and embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R^1$, and an upper limit, $R_u$, is disclosed, any number falling within the range is specifically disclosed. In particular, the following numbers within the range are specifically disclosed: $R=R_1+k^*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of Accordingly, the scope of protection is not limited by the description set out above but is defined by the claims that follow, that scope including all equivalents of the subject matter of the claims. Each and every claim is incorporated as further disclosure into the specification and the claims are aspect(s) and/or embodiment(s) of the disclosed inventive subject matter. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

What is claimed is:

1. A method comprising:

measuring a concentration of at least one hydrocarbon of a vent gas in a vent gas stream upstream of a combustion zone of a flare;

feeding the vent gas in the vent gas stream to the flare; and controlling, in real-time based at least in part on the concentration of the at least one hydrocarbon, a flow of steam or air to the flare.

2. The method of claim 1, wherein the flow of steam to the flare is controlled, wherein the step of controlling a flow of steam to the flare comprises:

calculating a molecular weight of the vent gas in the vent gas stream using the concentration of the at least one hydrocarbon and a molecular weight of the at least one hydrocarbon;

measuring a velocity of the vent gas in the vent gas stream;

calculating a mass flow rate of the vent gas in the vent gas stream using the measured vent gas velocity, a molar volume of 385.3 SCF/LB-MOL, and the calculated molecular weight;

determine a current flow rate of steam to the flare;

calculating a total steam:vent gas mass ratio for smokeless operation of the flare using the concentration of the at least one hydrocarbon in the vent gas stream multiplied by a standard steam:hydrocarbon ratio required for smokeless operation of the flare for the at least one hydrocarbon;

calculating a required steam flow rate for the flow of steam to the flare using the total steam:vent gas mass ratio and the vent gas mass flow rate; and adjusting the flow of steam to the flare to the required steam flow rate.

3. The method of claim 1, wherein the flow of air to the flare is controlled, wherein the step of controlling a flow of air to the flare comprises:

calculating a molecular weight of the vent gas in the vent gas stream using the concentration of the at least one hydrocarbon and a molecular weight of the at least one hydrocarbon;

measuring a velocity of the vent gas in the vent gas stream;

calculating a volumetric flow rate of the vent gas in the vent gas stream using the calculated velocity;

calculating a total air:vent gas mole ratio for smokeless operation of the flare using the concentration of the at least one hydrocarbon in the vent gas stream multiplied by a standard air:hydrocarbon ratio required for smokeless operation of the flare for the at least one hydrocarbon;

calculating a required air flow rate for the flow of air to the flare by multiplying the total air:vent gas mole ratio by the volumetric flow rate of the vent gas in the vent gas stream; and adjusting a flow of air to the flare to the required air flow rate.

4. The method of claim 1, further comprising:

controlling, in real-time based at least in part on the concentration of the at least one hydrocarbon, a flow of natural gas or fuel gas into the vent gas stream.

5. The method of claim 4, wherein controlling a flow of natural gas or fuel gas comprises:

calculating a net heating value of the vent gas in the vent gas stream using the concentration of the at least one hydrocarbon and a net heating value for the at least one hydrocarbon;

calculating a first flow rate for the natural gas or fuel gas that is required to change the net heating value of the vent gas in the vent gas stream to meet a first setpoint value, wherein the first setpoint value is defined as equal to or greater than a minimum net heating value for a vent gas specified by regulation;

calculating a net heating value in a combustion zone of the flare using the flow rate of the vent gas in the vent gas stream, a flow rate of steam to the flare, and the net heating value for the vent gas;

calculating a second flow rate for the natural gas or fuel gas that is required to change the net heating value in the combustion zone to meet a second setpoint value, wherein the second setpoint value is optionally defined as equal to or greater than a minimum net heating value for a combustion zone specified by regulation;

determining and selecting which one of the net heating value of the vent gas in the vent gas stream and the net heating value in the combustion zone is a selected net heating value that requires more natural gas or fuel gas to meet the respective setpoint value (or alternatively stated, determining which one of the first flow rate and the second flow rate is greater, and identifying the greater one as a selected flow rate); and adjusting a flow of the natural gas or fuel gas to the selected flow rate.

6. The method of claim 4, wherein controlling a flow of natural gas or fuel gas comprises:

calculating a net heating value of the vent gas in the vent gas stream using the concentration of the at least one hydrocarbon and a net heating value for the at least one hydrocarbon;

calculating a first flow rate for the natural gas or fuel gas that is required to change the net heating value of the vent gas in the vent gas stream to meet a first setpoint value, wherein the first setpoint value is defined as equal to or greater than a minimum net heating value for a vent gas specified by regulation;

calculating a net heating value dilution parameter in a combustion zone of the flare using the flow rate of the vent gas in the vent gas stream, a flow rate of air to the flare, the net heating value for the vent gas, and a diameter of a tip of the flare;

calculating a second flow rate for the natural gas or fuel gas that is required to change the net heating value dilution parameter of the combustion zone to meet a second setpoint value, wherein the second setpoint value is defined as equal to or greater than a minimum net heating value dilution parameter for a combustion zone specified by regulation;

determining and selecting which one of the net heating value of the vent gas in the vent gas stream and the net heating value dilution parameter for the combustion zone is a selected net heating value that requires more natural gas or fuel gas to meet the respective setpoint value (or alternatively stated, determining which one of the first flow rate and the second flow rate is greater, and identifying the greater one as a selected flow rate); and adjusting the flow of the natural gas or fuel gas to the selected flow rate.

7. The method of claim 4, wherein controlling a flow of natural gas or fuel gas comprises:

calculating a first net heating value of the vent gas in the vent gas stream using the concentration of the at least one hydrocarbon that is received from a first gas analyzer and a net heating value for the at least one hydrocarbon;

calculating a second net heating value of the vent gas in the vent gas stream using the concentration of the at least one hydrocarbon that is received from a second gas analyzer and a net heating value for the at least one hydrocarbon;

multiplying the first net heating value of the vent gas by a ratio of the second net heating value of the vent gas to the first net heating value of the vent gas to obtain a reconciled net heating value of the vent gas;

calculating a first flow rate for the natural gas or fuel gas that is required to change the reconciled net heating value of the vent gas in the vent gas stream to meet a first setpoint value, wherein the first setpoint value is defined as equal to or greater than a minimum net heating value for a vent gas specified by regulation;

calculating a first net heating value dilution parameter in a combustion zone of the flare using the flow rate of the vent gas in the vent gas stream, a flow rate of steam to the flare, and the first net heating value for the vent gas calculated using the concentration of the at least one hydrocarbon that is received from the first gas analyzer;

calculating a second net heating value dilution parameter in the combustion zone of the flare using the flow rate of the vent gas in the vent gas stream, a flow rate of steam to the flare, and the second net heating value for the vent gas calculated using the concentration of the at least one hydrocarbon that is received from the second gas analyzer;

multiplying the first net heating value dilution parameter by a ratio of the second net heating value dilution parameter to the first net heating value dilution parameter to obtain a reconciled net heating value dilution parameter in the combustion zone;

calculating a second flow rate for the natural gas or fuel gas that is required to change the reconciled net heating value dilution parameter in the combustion zone to meet a second setpoint value, wherein the second setpoint value is defined as equal to or greater than a minimum net heating value dilution parameter for a combustion zone specified by regulation;

determining and selecting which one of the reconciled net heating value of the vent gas in the vent gas stream and the reconciled net heating value dilution parameter in the combustion zone is a selected net heating value that requires more natural gas or fuel gas to meet the respective setpoint value (or alternatively stated, determining which one of the first flow rate and the second flow rate is greater, and identifying the greater one as a selected flow rate); and adjusting a flow of the natural gas or fuel gas to the selected flow rate.

8. The method of claim 7, further comprising:

determining the net heating value of the vent gas calculated using information from the first gas analyzer and/or the second gas analyzer is less than a first target value, wherein the first target value is a minimum net heating value for a vent gas specified by regulation;

adjusting the first setpoint value to a higher vent gas setpoint value that is greater than the first setpoint value;

calculating a third flow rate for the natural gas or fuel gas that is required to change the net heating value of the vent gas in the vent gas stream to meet the higher vent gas setpoint value;

determining the net heating value in the combustion zone is less than a second target value, wherein the second target value can be a minimum net heating value in the combustion zone specified by regulation;

adjusting the second setpoint value to a higher combustion zone setpoint value that is greater than the second setpoint value;

calculating a fourth flow rate for the natural gas or fuel gas that is required to change the net heating value in the combustion zone to meet the higher combustion zone setpoint value;

determining which one of the third flow rate and the fourth flow rate is greater;

identifying the greater one as a selected flow rate; and adjusting the flow of the natural gas or fuel gas to the selected flow rate.

9. The method of claim 4, wherein controlling a flow of natural gas or fuel gas comprises:

calculating a first net heating value of the vent gas in the vent gas stream using the concentration of the at least one hydrocarbon that is received from a first gas analyzer and a net heating value for the at least one hydrocarbon;

calculating a second net heating value of the vent gas in the vent gas stream using the concentration of the at least one hydrocarbon that is received from a second gas analyzer and a net heating value for the at least one hydrocarbon;

multiplying the first net heating value of the vent gas by a ratio of the second net heating value of the vent gas to the first net heating value of the vent gas to obtain a reconciled net heating value of the vent gas;

calculating a first flow rate for the natural gas or fuel gas that is required to change the reconciled net heating value of the vent gas in the vent gas stream to meet a first setpoint value, wherein the first setpoint value is defined as equal to or greater than a minimum net heating value for a vent gas specified by regulation;

calculating a first net heating value dilution parameter in a combustion zone of the flare using the flow rate of the vent gas in the vent gas stream, a flow rate of air to the flare, and the first net heating value for the vent gas calculated using the concentration of the at least one hydrocarbon that is received from the first gas analyzer;

calculating a second net heating value dilution parameter in the combustion zone of the flare using the flow rate of the vent gas in the vent gas stream, a flow rate of air to the flare, a diameter of a tip of the flare, and the second net heating value for the vent gas calculated using the concentration of the at least one hydrocarbon that is received from the second gas analyzer;

multiplying the first net heating value dilution parameter by a ratio of the second net heating value dilution parameter to the first net heating value dilution parameter to obtain a reconciled net heating value dilution parameter in the combustion zone;

calculating a second flow rate for the natural gas or fuel gas that is required to change the reconciled net heating value dilution parameter in the combustion zone to meet a second setpoint value, wherein the second setpoint value is defined as equal to or greater than a minimum net heating value dilution parameter for a combustion zone specified by regulation;

determining and selecting which one of the reconciled net heating value of the vent gas in the vent gas stream and the reconciled net heating value dilution parameter in the combustion zone is a selected net heating value that requires more natural gas or fuel gas to meet the respective setpoint value (or alternatively stated, determining which one of the first flow rate and the second flow rate is greater, and identifying the greater one as a selected flow rate); and adjusting a flow of the natural gas or fuel gas to the selected flow rate.

10. The method of claim 9, further comprising:

determining the net heating value of the vent gas calculated using information from the first gas analyzer and/or the second gas analyzer is less than a first target value, wherein the first target value can be a minimum net heating value for a vent gas specified by regulation;

adjusting the first setpoint value to a higher vent gas setpoint value that is greater than the first setpoint value;

calculating a third flow rate for the natural gas or fuel gas that is required to change the net heating value of the vent gas in the vent gas stream to meet the higher vent gas setpoint value;

determining the net heating value dilution parameter in the combustion zone is less than a second target value, wherein the second target value can be a minimum net heating value dilution parameter in the combustion zone specified by regulation;

adjusting the second setpoint value to a higher combustion zone setpoint value that is greater than the second setpoint value;

calculating a fourth flow rate for the natural gas or fuel gas that is required to change the net heating value dilution parameter in the combustion zone to meet the higher combustion zone setpoint value;

determining which one of the third flow rate and the fourth flow rate is greater;

identifying the greater one as a selected flow rate; and adjusting the flow of the natural gas or fuel gas to the selected flow rate.

11. The method of claim 1, wherein the concentration of the at least one hydrocarbon is measured using an online tunable infrared absorption based gas analyzer, and wherein the concentration of the at least one hydrocarbon is additionally measured using gas chromatography.

12. The method of claim 1, further comprising:

measuring a hydrogen concentration in the vent gas stream; and controlling, in real-time based at least in part on the hydrogen concentration in the vent gas stream, the flow of steam or air to the flare.

13. The method of claim 1, wherein the step of measuring is performed by an online tunable infrared absorption based gas analyzer configured to analyze the vent gas in a sample stream taken from the vent gas stream or configured to analyze the vent gas in a flow path of the vent gas in the vent gas stream at a location between a knockout pot and the combustion zone of the flare.

* * * * *